US007817113B2

(12) United States Patent
Hashimoto et al.

(10) Patent No.: US 7,817,113 B2
(45) Date of Patent: Oct. 19, 2010

(54) METHOD FOR DRIVING A GAS ELECTRIC DISCHARGE DEVICE

(75) Inventors: Yasunobu Hashimoto, Kawasaki (JP); Yasushi Yoneda, Kawasaki (JP); Kenji Awamoto, Kawasaki (JP); Seiichi Iwasa, Kawasaki (JP)

(73) Assignee: Hitachi Plasma Patent Licensing Co., Ltd., Tokyo (JP)

( * ) Notice: Subject to any disclaimer, the term of this patent is extended or adjusted under 35 U.S.C. 154(b) by 0 days.

(21) Appl. No.: 12/382,821

(22) Filed: Mar. 24, 2009

(65) Prior Publication Data

US 2009/0251444 A1 Oct. 8, 2009

Related U.S. Application Data

(63) Continuation of application No. 11/828,047, filed on Jul. 25, 2007, now Pat. No. 7,675,484, which is a continuation of application No. 11/182,826, filed on Jul. 18, 2005, now Pat. No. 7,719,487, which is a continuation of application No. 10/188,858, filed on Jul. 5, 2002, now Pat. No. 6,982,685, which is a continuation of application No. 09/227,082, filed on Jan. 5, 1999, now Pat. No. 6,456,263.

(30) Foreign Application Priority Data

Jun. 5, 1998 (JP) ..... 10-157107

(51) Int. Cl.
*G09G 3/28* (2006.01)

(52) U.S. Cl. ..... 345/63; 345/67; 345/68; 345/690; 315/169.1; 315/169.2; 315/169.4

(58) Field of Classification Search ..... 345/60, 345/63, 68, 77, 204, 208, 690–692; 315/169.1, 315/169.2, 169.4
See application file for complete search history.

(56) References Cited

U.S. PATENT DOCUMENTS 3,854,072 A 12/1974 Trogdon
3,906,451 A 9/1975 Strom (Continued)

FOREIGN PATENT DOCUMENTS

EP 0 680 067 11/1995

(Continued)

OTHER PUBLICATIONS

Larry F. Weber, "Plasma Display Challenges", Asia Display '98 Digest, pp. 15-27 (1998).

(Continued)

*Primary Examiner*—Henry N Tran

(57) ABSTRACT

A method for driving a plasma display panel having at least first electrodes and second electrodes which cause discharge in cells is provided. The method includes applying a first pulse and a second pulse to the second electrode in an address preparation period. The method also includes applying a scan pulse to the second pulse to the second electrode in an address period. The method includes the first pulse having a voltage changing with time in a positive direction and the second pulse having a voltage changing with time in a negative direction and the scan pulse having a negative voltage which is lower than the attained voltage of the second pulse.

5 Claims, 17 Drawing Sheets

U.S. PATENT DOCUMENTS

| | | | |
|---|---|---|---|
| 4,063,131 | A | 12/1977 | Miller |
| 4,430,601 | A | 2/1984 | Boyd et al. |
| 4,611,203 | A | 9/1986 | Scriscimagna et al. |
| 4,737,687 | A | 4/1988 | Shinoda et al. |
| 5,541,618 | A | 7/1996 | Shinoda |
| 5,656,893 | A | 8/1997 | Shino et al. |
| 5,663,741 | A | 9/1997 | Kanazawa |
| 5,745,086 | A | 4/1998 | Weber |
| 5,757,343 | A | 5/1998 | Nagakubo |
| 5,790,087 | A | 8/1998 | Shigeta et al. |
| 5,835,072 | A | 11/1998 | Kanazawa |
| 5,874,932 | A | 2/1999 | Nagaoka et al. |
| 5,877,734 | A | 3/1999 | Amemiya |
| 5,943,031 | A | 8/1999 | Tokunaga et al. |
| 5,952,986 | A | 9/1999 | Nguyen et al. |
| 5,969,478 | A | 10/1999 | Shino et al. |
| 5,982,344 | A | 11/1999 | Tokunaga |
| 6,020,687 | A | 2/2000 | Hirakawa et al. |
| 6,034,482 | A | 3/2000 | Kanazawa et al. |
| 6,037,916 | A | 3/2000 | Amemiya |
| 6,118,416 | A | 9/2000 | Nakamura et al. |
| 6,124,849 | A | 9/2000 | Ito et al. |
| 6,140,984 | A | 10/2000 | Kanazawa et al. |
| 6,160,529 | A | 12/2000 | Asao et al. |
| 6,160,530 | A | 12/2000 | Makino |
| 6,181,305 | B1 | 1/2001 | Nguyen et al. |
| 6,195,075 | B1 | 2/2001 | Shino et al. |
| 6,211,865 | B1 | 4/2001 | Hosoi et al. |
| 6,243,084 | B1 | 6/2001 | Nagai |
| 6,249,087 | B1 | 6/2001 | Takayama et al. |
| 6,256,001 | B1 | 7/2001 | Kim et al. |
| 6,262,699 | B1 | 7/2001 | Suzuki et al. |
| 6,342,874 | B1 | 1/2002 | Tokunaga et al. |
| 6,369,781 | B2 | 4/2002 | Hashimoto et al. |
| 6,369,782 | B2 | 4/2002 | Shigeta |
| 6,373,452 | B1 | 4/2002 | Ishii et al. |
| 6,400,342 | B2 | 6/2002 | Hirakawa |
| 6,414,653 | B1 | 7/2002 | Kobayashi |
| 6,456,263 | B1 | 9/2002 | Hashimoto et al. |
| 6,707,436 | B2 | 3/2004 | Setoguchi et al. |

FOREIGN PATENT DOCUMENTS

| | | |
|---|---|---|
| EP | 0 762 373 | 3/1997 |
| EP | 0 836 171 | 4/1998 |
| JP | 6-175607 | 6/1994 |
| JP | 6-314078 | 11/1994 |
| JP | 7-175438 | 7/1995 |
| JP | 8-160910 | 6/1996 |
| JP | 08-160912 | 6/1996 |
| JP | 9-6280 | 1/1997 |
| JP | 9-160525 | 6/1997 |
| JP | 10-9116 | 1/1998 |
| JP | 10-55152 | 2/1998 |
| JP | 10-10511 | 4/1998 |
| JP | 10-91116 | 4/1998 |
| JP | 10-307560 | 11/1998 |
| KR | 1997-0051699 | 7/1997 |
| WO | 97 20301 A | 6/1997 |

OTHER PUBLICATIONS

U.S. Office Action mailed Jul. 10, 2009 in related U.S. Appl. No. 11/182,826.

Notice of Allowance mailed Oct. 22, 2009 in related U.S. Appl. No. 11/828,047.

METHOD FOR DRIVING A GAS ELECTRIC DISCHARGE DEVICE

CROSS-REFERENCE TO RELATED APPLICATIONS

This application is related to and is a continuation of Ser. No. 11/828,047 filed Jul. 25, 2007 now U.S. Pat. No. 7,675,484 which is a continuation of Ser. No. 11/182,826 filed Jul. 18, 2005, now U.S. Pat. No. 7,719,487, which is a continuation of Ser. No. 10/188,858 filed Jul. 5, 2002, now U.S. Pat. No. 6,982,685 issued on Jan. 3, 2006, which is a continuation of Ser. No. 09/227,082 filed Jan. 5, 1999, now U.S. Pat. No. 6,456,263 issued on Sep. 24, 2002, the disclosures of which are incorporated herein by reference. This application also claims priority to Japanese application No. HEI 10(1998)-157107, filed on Jun. 5, 1998, whose priority is claimed under 35 U.S.C. §119, the disclosure of which is incorporated herein by reference.

BACKGROUND OF THE INVENTION

1. Field

The embodiments discussed herein are directed to a method for driving gas electric discharge devices typified by PDPs (plasma display panels) and PALC (plasma addressed liquid crystal) display panels.

PDPs have been becoming widespread as large-screen display devices for television since color display became operational with the PDPs. The larger screen a PDP has, the more difficult it is to establish a uniform structure in all cells on the screen, and therefore, the PDP is required to be driven by a driving method which has a large voltage margin of voltage to allow for variations in discharge characteristics among the cells.

2. Description of the Related Art

Three-electrode AC PDPs of surface-discharge structure are commercialized as color display devices. In such PDPs, a pair of main electrodes (a first electrode and a second electrode) for sustaining light emission is disposed on every line (row) of a matrix for display and an address electrode (a third electrode) for addressing a cell is disposed on every column of the matrix. In addressing, one of the pair of main electrodes (e.g., the second electrode) is used for selecting a line. In the surface-discharge structure, fluorescent layers for color display are formed on a substrate opposed to a substrate on which the pairs of main electrodes are disposed. Thereby deterioration of the fluorescent layers by ion impact at discharges can be reduced and thus the life of the PDP can be extended. PDPs of "reflection type" which have the fluorescent layers on their rear substrates are superior in luminous efficiency to those of "transmission type" which have the fluorescent layers on their front substrates.

A memory function of a dielectric layer covering the main electrodes is utilized for display. More particularly, addressing is performed by line-by-line scanning for preparing a charged state according to the content of display, and then a sustain voltage Vs of alternating polarity is applied to the main electrode pair of each line for light emission. The sustain voltage Vs satisfies the following formula (1):

$$Vf-Vw<Vs<Vf \qquad \text{Formula (1)}$$

wherein Vf is a firing voltage and Vw is a wall voltage.

When the sustain voltage Vs is applied, a cell voltage (the sum of the wall voltage and the applied voltage, also referred to as an effective voltage Veff) exceeds the firing voltage only in cells where wall charge exists, so that a surface discharge is generated in the cells along the face of the substrate. If the cycle of applying the sustain voltage Vs is shortened, it is possible to obtain an illumination state which appears continuous.

The luminance of display depends on the number of discharges per unit time. Accordingly, halftones are reproduced by setting the number of discharges in one field for every cell according to levels of gradation to be produced. Color display is one sort of gradation display, and a displayed color is determined by combination of luminances of the three primary colors. In the present specification, the "field" defines a unit image for time-sequential image display. That is, the "field" is a field of a frame displayed by interlaced scanning in the case of television and a frame itself in the case of non-interlaced scanning (which is regarded as a one-to-one interlaced scanning) typified by computer output.

In order to produce levels of gradation by the PDP, the field is time-sequentially divided into a plurality of sub-fields. The luminance (i.e., the number of discharges) in each sub-field has a weight. The total number of discharges in the field is determined by combining illumination and non-illumination on a sub-field basis. If the application cycle (driving frequency) of the sustain voltage Vs is constant, the sustain voltage Vs is applied for different time periods for different luminance weights. Basically, the sub-fields are assigned so-called "binary weights" represented by $2^q$ (q=0, 1, 2, 3, . . . ). For example, if the number K of sub-fields in one field is 8, 256 ($2^8$) levels of gradation from "0" to "255" can be produced. The binary weights are free of redundancy and suitable for multi-gradation display. In some cases, however, different sub-fields are purposely assigned the same weight for preventing pseudo-contour which may be involved with moving pictures or the like.

Each sub-field is allotted an address period and an illumination sustaining period (hereafter referred to as a sustain period) as well as an address preparation period for uniforming charged states of all cells. For it is difficult to control a discharge for addressing if cells retaining wall charge for sustaining illumination co-exist with cells not retaining the wall charge.

Conventionally, for the address preparation, a voltage exceeding the firing voltage is applied to all cells to generate a strong discharge therein, thereby to render the entire screen into a substantially uncharged state. The strong discharge produces an excessive amount of wall charge in all cells. Then, the application of voltage is stopped so that an self-erase discharge is generated by the wall charge and then the wall charge disappears. In the address period subsequent to the address preparation period, addressing is performed to generate an address discharge only in cells to be illuminated and thereby to produce a new wall charge therein.

One problem of the conventional driving method is that, since the wall charge is erased in the address preparation, the voltage applied in the addressing must be set in consideration of variations in the firing voltage Vf of the cells due to subtle differences in the structure of the cells. As a result, a voltage margin which allows proper addressing is reduced by the range of the variations in the firing voltage Vf.

Another problem is an increase in the luminance of background. That is, because the strong discharge is generated in the address preparation period not only in cells to illuminate in the next sustain period but also in cells not to illuminate in the next sustain period, the background, which occupies the greater part of the screen, looks bright and thus contrast declines.

Further, since the polarity of the voltage applied in the address preparation period determines the polarity of the sustain voltage Vs applied last in the sustain period, the number of discharges in the sustain period (i.e., the number of applied sustain voltage pulses) is required to be either odd or even through all the sub-fields. For this requirement, the number of discharges in each sub-field must be set at least on a two-time basis, and thus delicate adjustment of luminance is impossible. It is noted that, if the polarity of the sustain voltage Vs in some sub-fields is set different from that in other sub-fields, the voltage for generating the self-erase discharge must be set impractically high.

SUMMARY OF THE INVENTION

It is an aspect of the embodiments discussed herein to provide a reduction in the voltage margin due to the variations in the firing voltage Vf for improving the reliability of driving. Another aspect of the embodiments discussed herein is to reduce the luminance of the background for improving the contrast. Still, another aspect of the embodiments discussed herein is to relieve limitations on the polarity of applied voltage for increasing flexibility of drive sequences.

The above aspects can be attained by a method for driving a gas electric discharge device having a first electrode and a second electrode for a gas electric discharge which device is constructed such that a wall voltage is capable of being produced between the first and the second electrode, the method comprising applying a voltage monotonously rising from a first set value to a second set value, between the first and the second electrode, thereby to generate a plurality of gas electric discharges so as to decrease the wall voltage for charge adjustment during the voltage rise.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE EMBODIMENTS

According to an exemplary embodiment, in order to ensure that a discharge of proper strength is generated across all gaps between electrodes, which gaps allow independent generation of discharges, by application of a predetermined drive voltage regardless of difference in firing voltage, a gradually increasing voltage is applied across the gaps for preparation, so that wall voltages are produced across the gaps in amounts corresponding to the firing voltages of the gaps. Thereby, when the predetermined drive voltage is applied, an effective voltage across each of the gaps can become higher than the firing voltage of said gap by a given value. In other words, differences between the firing voltages and the effective voltages, which determine the intensity of discharges, are equalized. Thus the margin of the predetermined drive voltage is enlarged.

Figure 1A:
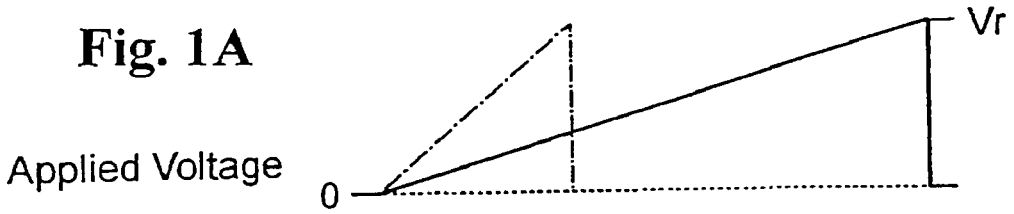
FIGS. 1A to 1D illustrate waveforms illustrating a principle of a method according to an exemplary embodiment.
Figure 1B:
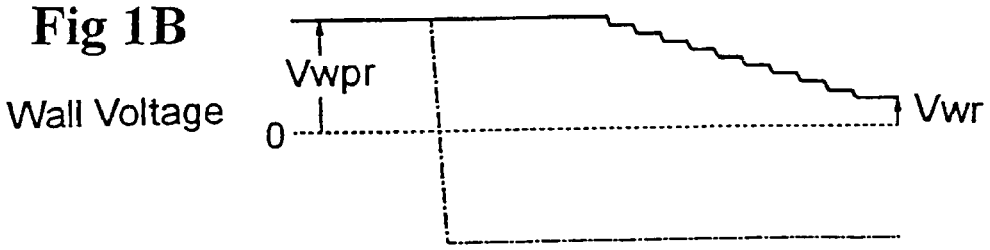
Figure 1C:
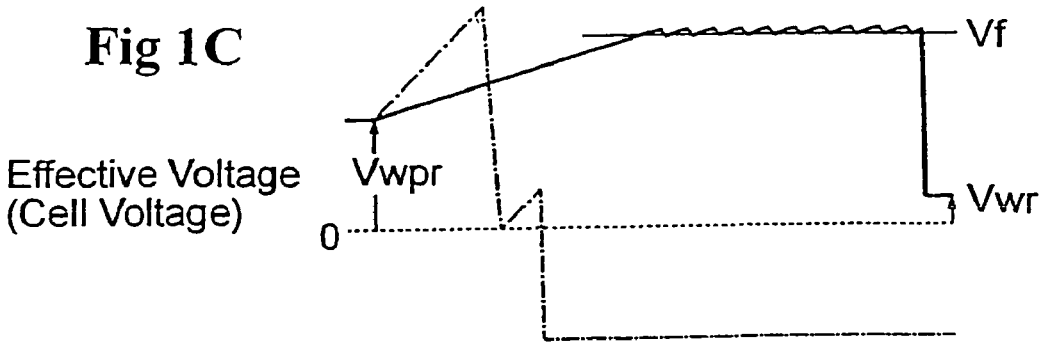
Figure 1D:
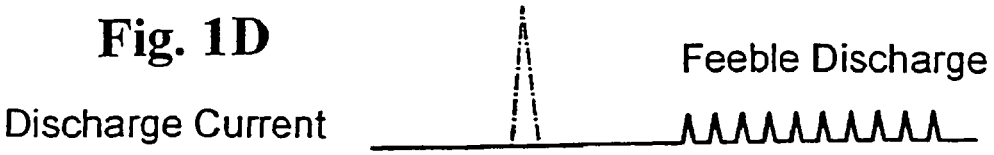
Figure 2:
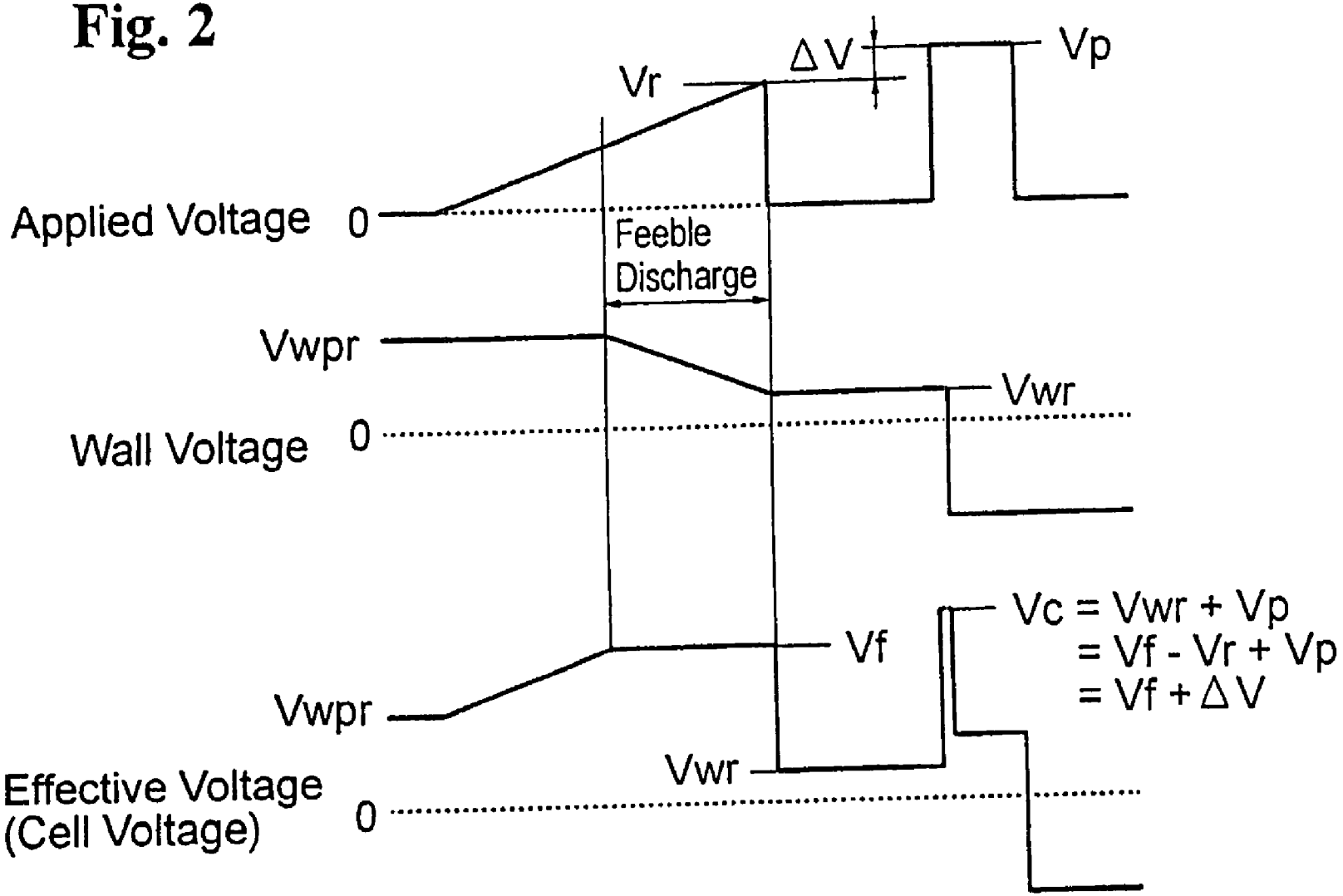
FIG. 2 shows voltage waveforms illustrating a principle a method according to an exemplary embodiment.
Figure 3:
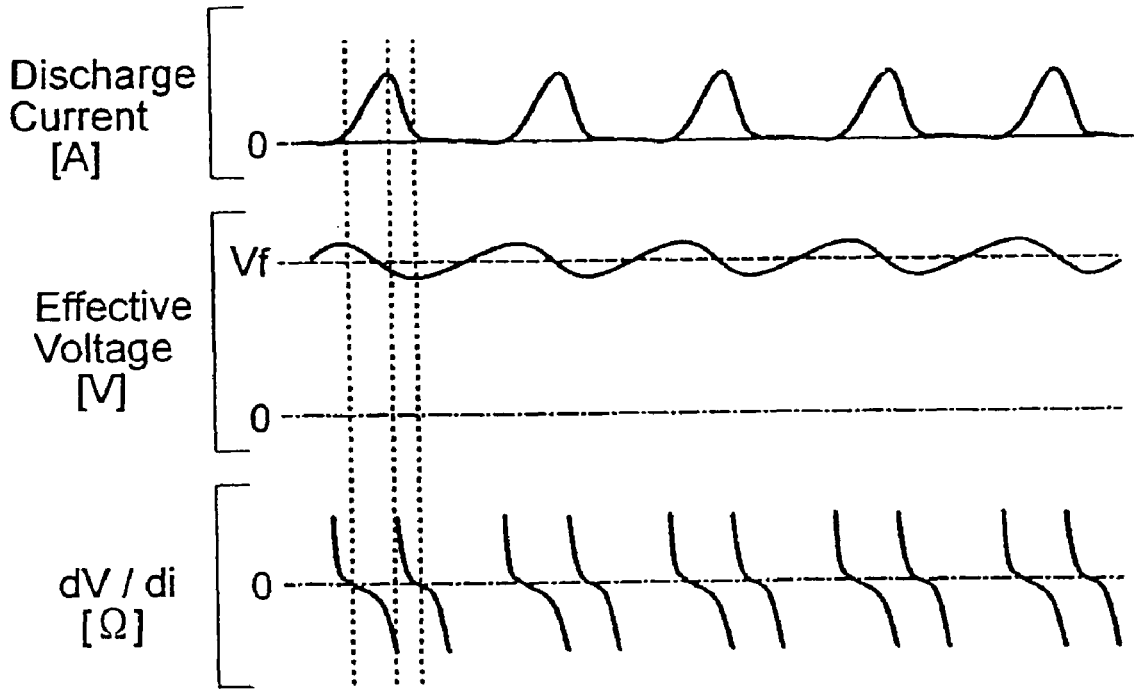
FIG. 3 shows waveforms illustrating current and voltage characteristics in a feeble discharge according to an exemplary embodiment.

FIGS. 1A to 1D and FIG. 2 show waveforms illustrating a principle of an exemplary embodiment, and FIG. 3 shows waveforms illustrating current and voltage characteristics in a feeble discharge according to an exemplary embodiment.

A voltage which "gradually" increases from a first value (0V in this example) to a second value Vr as indicated by a solid line in FIG. 1A is applied between a pair, of electrodes. This voltage is referred to as "charge adjusting voltage." The illustrated charge adjusting voltage is a positive ramp voltage. However the charge adjusting voltage may be negative and the waveform thereof is not limited to a ramp form.

Letting the wall voltage between electrodes have a value Vwpr at the beginning of the application of the charge adjusting voltage, the effective voltage gradually increases from Vwpr as shown in FIG. 1C as the voltage increases. When the effective voltage reaches the firing voltage Vf, a first discharge takes place with a little delay. At this time, the effective voltage is only slightly higher than the firing voltage, and the discharge is week and finishes at once, because the effective voltage becomes lower than the firing voltage Vf with only a little loss of the wall voltage. In this pulse-like discharge, the drop of the wall voltage exceeds the increase of the applied voltage momentarily, and the effective voltage decreases. When the effective voltage decreases, the value of dV/di (wherein V is the effective voltage and i is current) becomes negative (see FIG. 3). The effective voltage starts to increase again when the discharge finishes. When the effective voltage exceeds the firing voltage again with the increasing applied voltage, a second discharge takes place. This discharge is also weak and finishes immediately. Thereafter, while the charge adjusting voltage is being applied, the weak discharge (referred to as feeble discharge) is repeated periodically and the wall charge drops a little every time when the feeble discharge occurs. The effective voltage remains substantially at the firing voltage Vf from the first occurrence of the feeble discharge to the end of the application of the charge adjusting voltage, though the effective voltage changes periodically at every feeble discharge within a small range across the firing voltage Vf. When the application of the charge adjusting voltage ends, the effective voltage drops to a value of the wall voltage at the end of the last feeble discharge, Vwr. The value Vwr generally equals to a difference between the firing voltage Vf and the maximum value of the applied voltage Vr, as represented by the formula (1):

$$Vwr = Vf - Vr \quad \text{Formula (1)}$$

By applying the charge adjusting voltage to generate the feeble discharge successively in the above-described manner, the amount of the wall charge between each pair of electrodes can be adjusted to the value Vwr according to the firing voltage Vf of said pair of electrodes, which depends upon the structure of said pair, if the wall voltage Vwpr at the beginning of the application is within a range allowing the discharge to be generated.

The term "gradually" is defined as the rate of change of the applied voltage is within such a range as allows successive generation of the feeble discharge. For example, the maximum limit of the range allowing the generation of the feeble discharge may be about 10[V/μs] in a commercialized PDP. As obviously seen from the formula (1), the value of the wall charge at the end of the application, Vwr, is not dependent on the value of the wall charge at the beginning of the application, Vwpr, but is determined by a setting of the maximum value of the applied voltage. Besides, the feeble discharge is so weak that a discharge gas is scarcely excited, so that light emission does not occur or, if occurs, is extremely weak. Therefore, even if the feeble discharge is repeated a lot of times, the contrast of display is not impaired.

If a steeply rising voltage (including a voltage in a rectangular form) is applied as indicated by a dotted line in FIG. 1A, the effective voltage causing the first discharge is much higher than the firing voltage. Accordingly a strong discharge is generated and reverses the polarity of the wall charge. For this reason, the effective voltage does not exceed the firing voltage Vf thereafter and the discharge is not repeated any more. On the other hand, if an extremely gentle voltage whose rate of rise is smaller than the minimum limit of the above-described range for the "gradually" rising voltage, current flows continuously with the effective voltage approaching but not exceeding the firing voltage Vf and the wall charge decreases gradually. The effective voltage and the current remains almost constant, and the value of dV/di is always positive. It may be possible to adjust the wall voltage using this phenomenon, but time necessary for decreasing the wall voltage sufficiently is much longer than in the case where the feeble discharge is generated as disclosed by an exemplary embodiment. An exemplary embodiment enables the adjustment of wall voltage to be adjusted in shorter time.

Next, consideration is given to the case of applying a voltage in a rectangular waveform whose polarity is the same as that of the charge adjusting voltage subsequently to the application of the charge adjusting voltage, as shown in FIG. 2. Supposing the wave height (amplitude) of the rectangular voltage is Vp, the effective voltage Vc at the application of the rectangular voltage is different by ΔV (=Vp−Vr) from the firing voltage Vf across the gap between electrodes, as indicated by the formula (2). When ΔV is a positive value, a discharge takes place and, when ΔV is a negative value, a discharge does not take place.

$$\begin{aligned} Vc &= Vwr + Vp \\ &= Vf - Vr + Vp \\ &= Vf + \Delta V \end{aligned} \quad \text{Formula (2)}$$

$$\Delta V : Vp - Vr$$

That is, the discharge intensity becomes uniform among all the gaps between electrodes by selecting the settings of Vr and Vp even if the gaps between electrodes have different firing voltages. If the rectangular voltage is, for example, a pulse for addressing in the driving of the PDP, the voltage margin for the addressing can be widened by generating the feeble discharge before the application of the pulse in order to adjust the wall voltages.

To widen the voltage margin, the rectangular voltage and the charge adjusting voltage are required to have the same polarity. If they are of different polarities, the wall voltage changes to widen differences in the firing voltages at the gaps between electrodes. Thus the voltage margin is narrowed.

In order to generate the feeble discharge to prepare a wall voltage corresponding to the value of the firing voltage as described above, the wall voltage at the beginning of the application of the charge adjusting voltage, Vwpr, is required to be higher than the value of the wall voltage at the end of the application of the charge adjusting voltage, Vwr. Accordingly, if a part or all of the wall charges across the gaps between the electrodes do not satisfy this requirement, wall charges satisfying the aforesaid requirement must be produced across all the gaps of the electrodes beforehand. However, in the case where the feeble discharge occurs successively, the value Vwpr need not be controlled strictly because the value Vwr depends upon the firing voltage Vf but does not depend upon the value Vwpr.

Here, assumed is the case where the feeble discharge is generated as a pre-treatment for the addressing (i.e., an address preparation) of the PDP. In this case, a voltage whose polarity is selected according to that of the charge adjusting voltage is applied after the end of the sustain period of a sub-field, prior to the application of the charge adjusting voltage. This voltage is referred to as "charge producing voltage." The "charge producing voltage" may generate discharges in all cells or only in cells in which the wall charge does not exist (i.e., cells in which the wall charge has been erased in the previous addressing). In such address preparation wherein two voltages, i.e., the charge producing voltage and the charge adjusting voltage, are applied, a desired wall voltage can be produced in each of the cells regardless of the polarity of the wall charge at the end of the sustain period, unlike the conventional application of only one voltage for erasing the wall charge. Thus, the number of discharges need not be made consistent in the sustain periods of all the sub-fields. The number of discharges in each sub-field can be set on a one-by-one basis and the weight of luminance can be optimized more easily. Further, since the address preparation does not produce an excessive wall charge which may cause a self-erase discharge, the wall charge shifts only in a small amount at the discharge generated by the application of the charge producing voltage, and the intensity of light emission is small. Thus, the contrast of display is improved compared with the conventional technique.

Accordingly, an exemplary embodiment provides a method for driving a gas electric discharge device having a first electrode and a second electrode for a gas electric discharge which device is constructed such that a wall voltage is capable of being produced between the first and the second electrode, the method comprising applying a voltage monotonously rising from a first set value to a second set value, between the first and the second electrode, thereby to generate a plurality of gas electric discharges so as to decrease the wall voltage for charge adjustment during the voltage rise.

Further, an exemplary embodiment provides a method for driving a gas electric discharge device having a plurality of cells each defining a unit electric discharge area and each having a first electrode and a second electrode for a gas electric discharge, which device is constructed such that a wall voltage is capable of being produced between the first and the second electrode, the method comprising, as preparation for generating a gas electric discharge of a predetermined intensity, commonly applying a voltage monotonously rising from a first set value to a second set value, between the first and the second electrodes, thereby to generate a plurality of gas electric discharges in each cell so as to decrease the wall voltage for charge adjustment during the voltage rise.

Still further, an exemplary embodiment provides a method for driving a gas electric discharge device having a plurality of cells defining a display screen and each having a scan electrode for line selection and a data electrode for column selection crossed each other, in which at least one of the scan electrode and the data electrode is covered with a dielectric layer for generating a wall voltage, the method comprising a repeated execution of address preparation for uniforming a charge distribution on the display screen, addressing for producing a charge distribution according to the content of display, and illumination sustainment for generating a gas electric discharge periodically by applying an alternate current, wherein the address preparation includes charge production for producing a state such that wall voltages of the same polarity are present in all the cells and charge adjustment by commonly applying a voltage monotonously rising from a first set value to a second set value, between the scan and the data electrode in each cell, thereby to generate a plurality of gas electric discharges in the cell so as to decrease the wall voltage for charge adjustment during the voltage rise.

An exemplary embodiment also provides a method for driving a gas electric discharge device having a plurality of cells defining a display screen and each having a first main electrode and a second main electrode arranged in parallel to form an electrode pair for generating a surface electric discharge, in which at least one of the first main electrode and the second main electrode is covered with a dielectric layer for generating a wall voltage, the method comprising a repeated execution of address preparation for uniforming a charge distribution on the display screen, addressing for producing a charge distribution according to the content of display and illumination sustainment for generating a gas electric discharge periodically by applying an alternate current, wherein the address preparation includes charge production for producing a state such that wall voltages of the same polarity are present in all the cells and charge adjustment by commonly applying a voltage monotonously rising from a first set value to a second set value, between the first and the second main electrode in each cell, thereby to generate a plurality of gas electric discharges in the cell so as to decrease the wall voltage for charge adjustment while the voltage rise.

In the method according to an exemplary embodiment, the first set value may be so set that the sum of the first set value and the wall voltage at the beginning of applying the monotonously rising voltage is lower than or equal to a firing voltage, the second set value may be so set that the sum of the second set value and the wall voltage at the beginning of applying the monotonously rising voltage is higher than the firing voltage, and the rate of rise from the first voltage to the second voltage may be a value within a range such that a feeble electric discharge which does not reverse the polarity of the wall voltage occurs intermittently.

In the method according to an exemplary embodiment, a voltage pulse in a ramp waveform whose polarity is reverse to that of the voltage applied in the charge adjustment may be applied to all the cells in the charge production of the address preparation.

In the method according to an exemplary embodiment, a voltage pulse in a rectangular waveform whose polarity is reverse to that of the voltage applied in the charge adjustment may be applied to all the cells in the charge production of the address preparation.

In the method according to an exemplary embodiment, a voltage pulse in a gentle waveform may be applied to all the cells in the charge adjustment of the address preparation.

In the method according to an exemplary embodiment, a voltage pulse in a stepwise waveform whose voltage rises stepwise may be applied to all the cells in the charge adjustment of the address preparation.

In the method according to an exemplary embodiment, in the addressing, a gas electric discharge may be generated only in a cell in which a gas electric discharge is to be generated in the illumination sustainment.

In the method according to an exemplary embodiment, in the addressing, a gas electric discharge may be generated only in a cell in which a gas electric discharge is not to be generated in the illumination sustainment.

In the method according to an exemplary embodiment, a field which represents display data may be composed of a plurality of sub-fields each assigned a weight of luminance. The address preparation, the addressing and the illumination sustainment may be executed in each of the sub-fields and the number of gas electric discharges in the illumination sustainment may be set on a one by-one basis.

An exemplary embodiment is now described in further detail by way of examples in conjunction with the accompanying drawings, which should not be construed to limit the scope.

Figure 4:
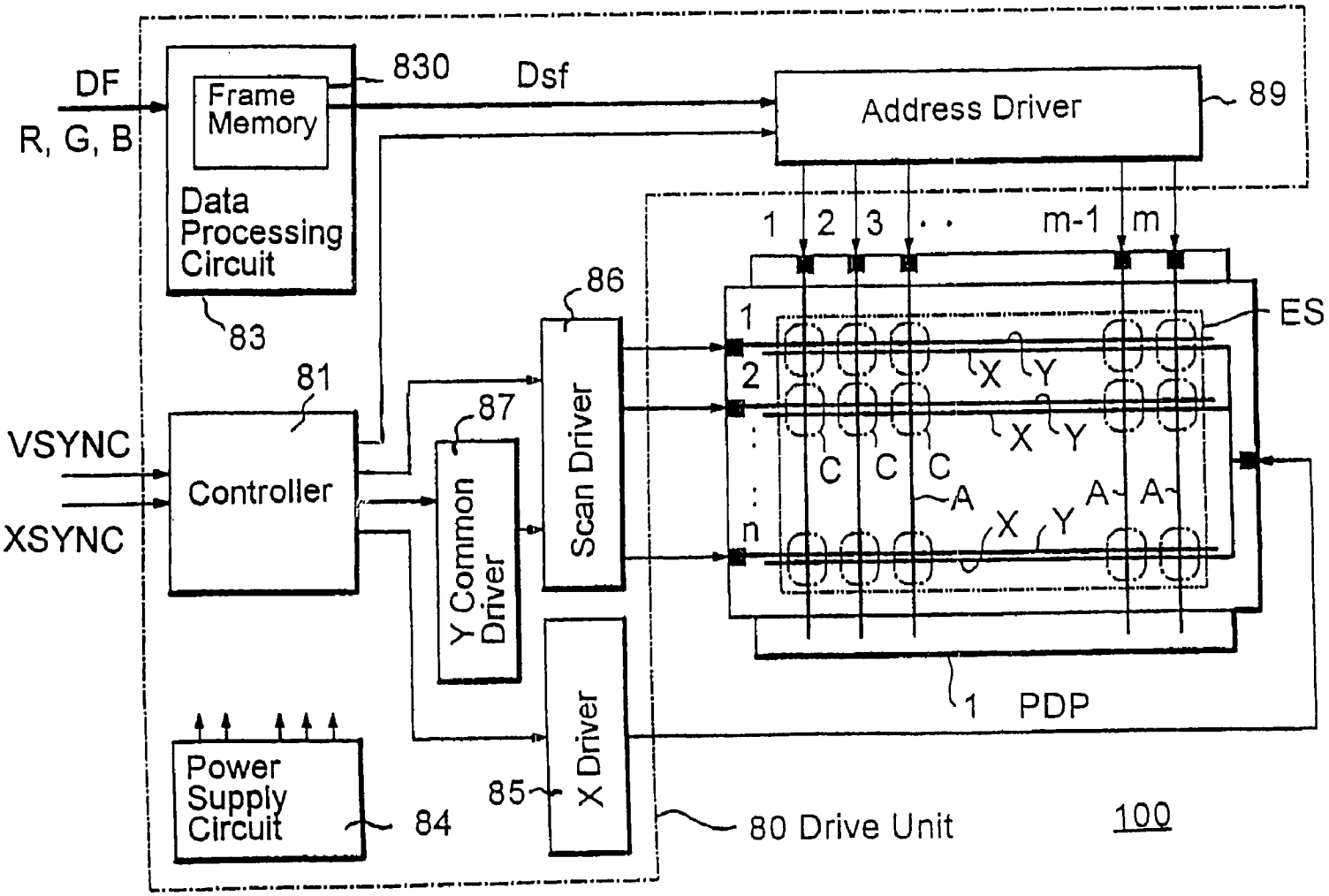
FIG. 4 is a diagram illustrating the construction of a plasma display device according to an exemplary embodiment.

FIG. 4 is a diagram illustrating the construction of a plasma display device 100 according to an exemplary embodiment.

The plasma display device 100 includes an AC PDP 1 which is a thin color display device of matrix type and a drive unit 80 for selectively illuminating a number of cells C arranged in m columns wide and n lines (rows) deep which define a screen ES. The plasma display device 100 is used as a wall-mount television display, a monitor of a computer system or the like.

The PDP 1 is a three-electrode surface-discharge to PDP in which first main electrodes X and second main electrodes Y which form electrode pairs for generating a discharge for sustaining illumination (also referred to as display discharge) are disposed in parallel and the first and second electrodes X and Y are crossed with an 20 address electrode A in each of the cells C. The main electrodes X and Y extend in a direction of the lines (in a horizontal direction) on the screen ES. The second main electrodes Y are used as scan electrodes for selecting cells C on a line basis in the addressing. The address electrodes extend in a direction of the columns (in a vertical direction) and are used as data electrodes for selecting cells C on a column basis. An area in which the main electrodes and the address electrodes cross is a display area (i.e., the screen ES).

The drive unit 80 includes a controller 81, a data processing circuit 83, a power supply circuit 84, an X driver 85, a scan driver 86, a common Y driver 87 and an address driver 89. The drive unit 80 is placed on a rear side of the PDP 1. The drivers are electrically connected with the electrodes of the PDP 1 by flexible cables, not shown. To the driver unit 80, field data DF indicating luminance levels of colors R, G and E3 (gradation levels) for each pixel is inputted together with various synchronizing signals from external equipment such as a TV tuner or a computer.

The field data DF is first stored in a frame memory 830 in the data processing circuit 83, and then converted into sub-field data Dsf for performing gradation display in a number of sub-fields into which the field is divided as described later. The sub-field data Dsf is stored in the frame memory 830 and transferred to the address driver 89 at appropriate times. The value of each bit in the sub-field data Dsf indicates whether or not a cell needs to be illuminated in a sub-field, more strictly, whether or not an address discharge is to be generated.

The X driver 85 applies a drive voltage simultaneously to all the main electrodes X. Electric sharing of the main electrodes X can be achieved not only by connections on the panel as shown in the figure but also by internal connections in the X driver 85 and as well as connections on cables for connection. The scan driver 86 applies a drive voltage to the individual main electrodes Y independently in the addressing. The common Y driver 87 applies a drive voltage to all the main electrodes Y for sustaining illumination. The address driver 89 selectively applies a drive voltage to the address electrodes A which amount to m in total according to the sub-field data Dsf. These drivers are supplied with power from the power supply circuit 84 via wiring conductors not shown.

Figure 5:
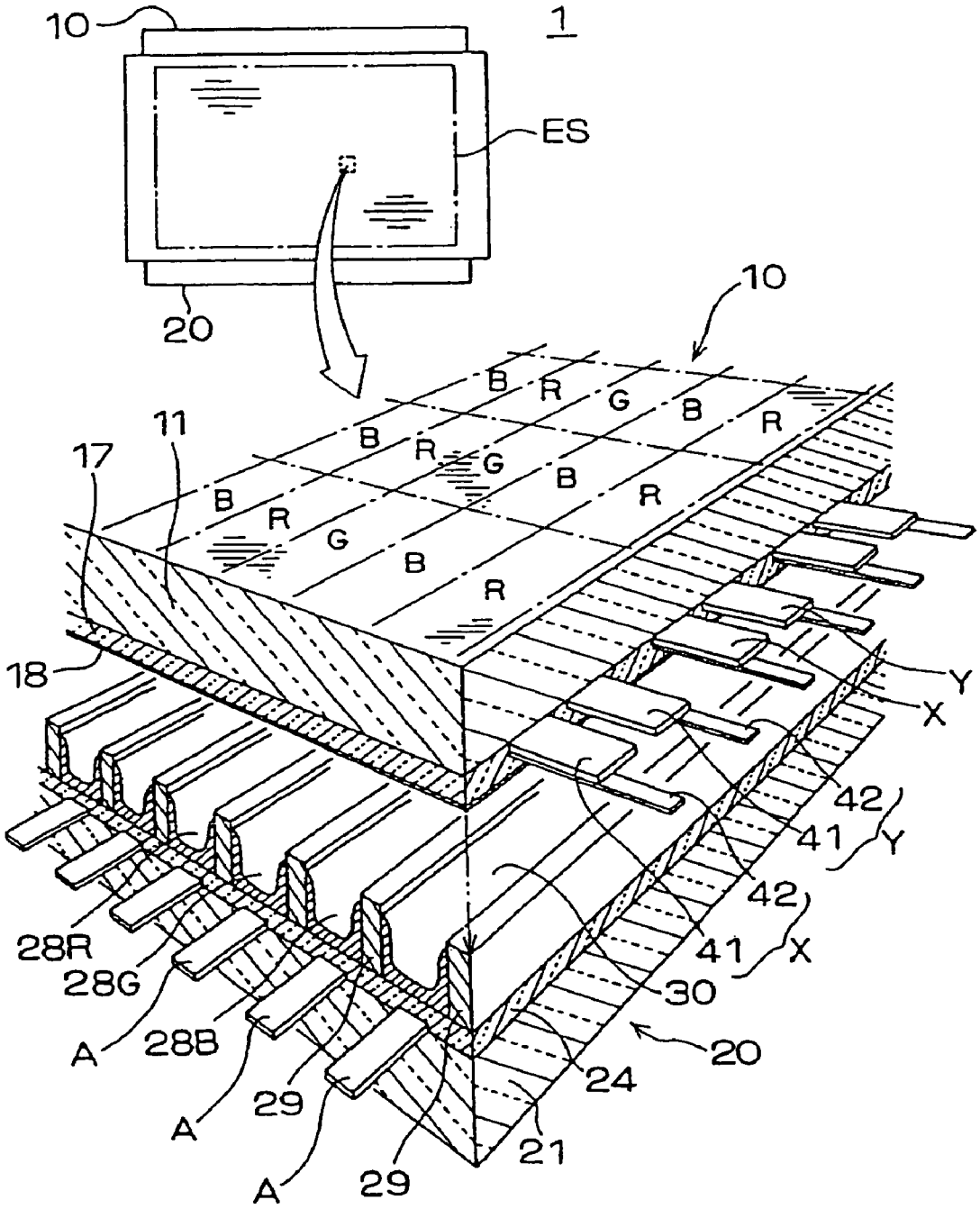
FIG. 5 is a perspective view illustrating the inner structure of a PDP according to an exemplary embodiment.

FIG. 5 is a schematic perspective view illustrating the inner structure of the PDP 1.

In the PDP 1, a pair of the main electrodes X and Y is disposed on each of the lines on an inner surface of a glass substrate 11 which is a base material for a front-side substrate structure. The line is a row of cells in the horizontal direction. The main electrodes X and Y are each composed of a transparent conductive film 41 and a metal film (bus conductor) 42 and covered with a dielectric layer 17 of low-melting glass of about 30 μm thickness. On the dielectric layer 17, provided is a protective film 18 of magnesia (MgO) of several thousand angstrom thickness. The address electrodes A are disposed on an inner surface of a glass substrate 21 which is a base material for a rear-side substrate structure and covered with a dielectric layer 24 of about 10 μm thickness. On the dielectric layers 24, provided are ribs 29 of 150 μm height in stripes, each being placed between the address electrodes A. The ribs 29 partition a discharge space 30 for every sub-pixel (a unit light-emission area) in the direction of the lines and defines the spacing of the discharge space 30. Fluorescent layers 28R, 28G and 28B of three colors, i.e., red, green and blue, for color display are provided to cover the inner surface on the rear side including surfaces above the address electrodes and side walls of the ribs 29. The discharge space 30 is filled with a discharge gas containing neon as main component mixed with xenon. The fluorescent layers 28R, 28G and 28B are locally excited by ultraviolet rays irradiated by xenon at discharges and emit light. One pixel for display is composed of three adjacent sub-pixels aligned in the direction of the line. A structure in each sub-pixel is a cell (display element) C. Since the ribs 29 are arranged in a stripe pattern, a part of the discharge space 30 corresponding to a column is continuous in the column direction, bridging all the lines L.

Now explanation is given to a method of driving the PDP 1 in the plasma display device 100. First, the outline of gradation display and drive sequences is described, and then voltages applied for driving the PDP which feature an exemplary embodiment are discussed in detail.

Figure 6:
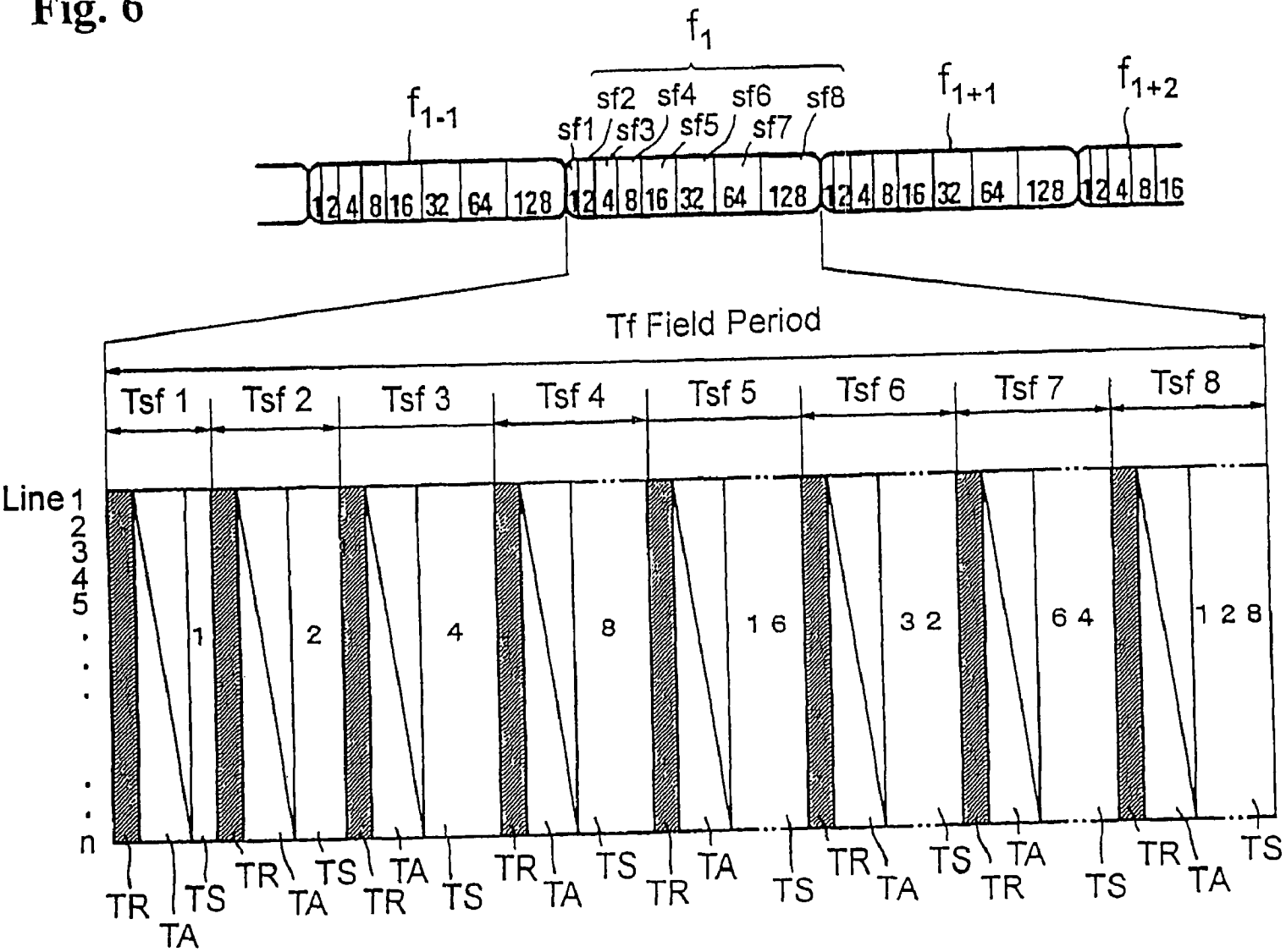
FIG. 6 illustrates the structure of fields according to an exemplary embodiment.

FIG. 6 illustrates the structure of fields.

In display of television images, for reproducing gradation by binary control on illumination, each field f which is a time-sequential input image is divided into, for example, eight sub-fields sf1, sf2, sf3, sf4, sf5, sf6, sf7, and sf8 (numerical subscripts indicate the order in which the sub-fields are displayed). In other words, each of the fields f composing the frame is replaced with a group of eight sub-fields sf1 to sf8. In the case of reproducing images of non-interlaced type like computer output, however, each frame is divided into eight. The sub-fields sf1 to sf8 are assigned weights of luminance so that relative ratio of luminance in the sub-fields sf1 to sf8 becomes about 1:2:4:8:16:32:64:128, and the numbers of sustain discharges in the sub-fields sf1 to sf8 are set according to the weights of luminance. Since 256 levels of luminance can be set for each of the colors R, G and B by combining illumination and non-illumination on a sub-field basis, the number of displayable colors is $256^3$. It is to be understood that the sub-fields sf1 to sf8 need not be displayed in the order of their weights of luminance. For example, the sub-field sf8 assigned the greatest weight of luminance may be displayed in the middle of a field period Tf for optimization.

A sub-field period Ts allotted to each sub-field $sf_j$ (e.g., j=1 to 8) includes an address preparation period TR during which charge adjustment specific to an exemplary embodiment is carried out, an address period TA during which a charge distribution is formed according to the content of display and a sustain period TS during which an illuminated state is sustained for ensuring the luminance according to a gradation level to be reproduced. In each sub-field period $Tsf_j$, the address preparation period TR and the address period TA are constant regardless of the weight of luminance assigned to the sub-field, while the sustain period TS is longer as the weight of luminance is greater. Accordingly, the sub-fields $Tsf_j$ corresponding to one field f are different from each other in length.

Figure 7:
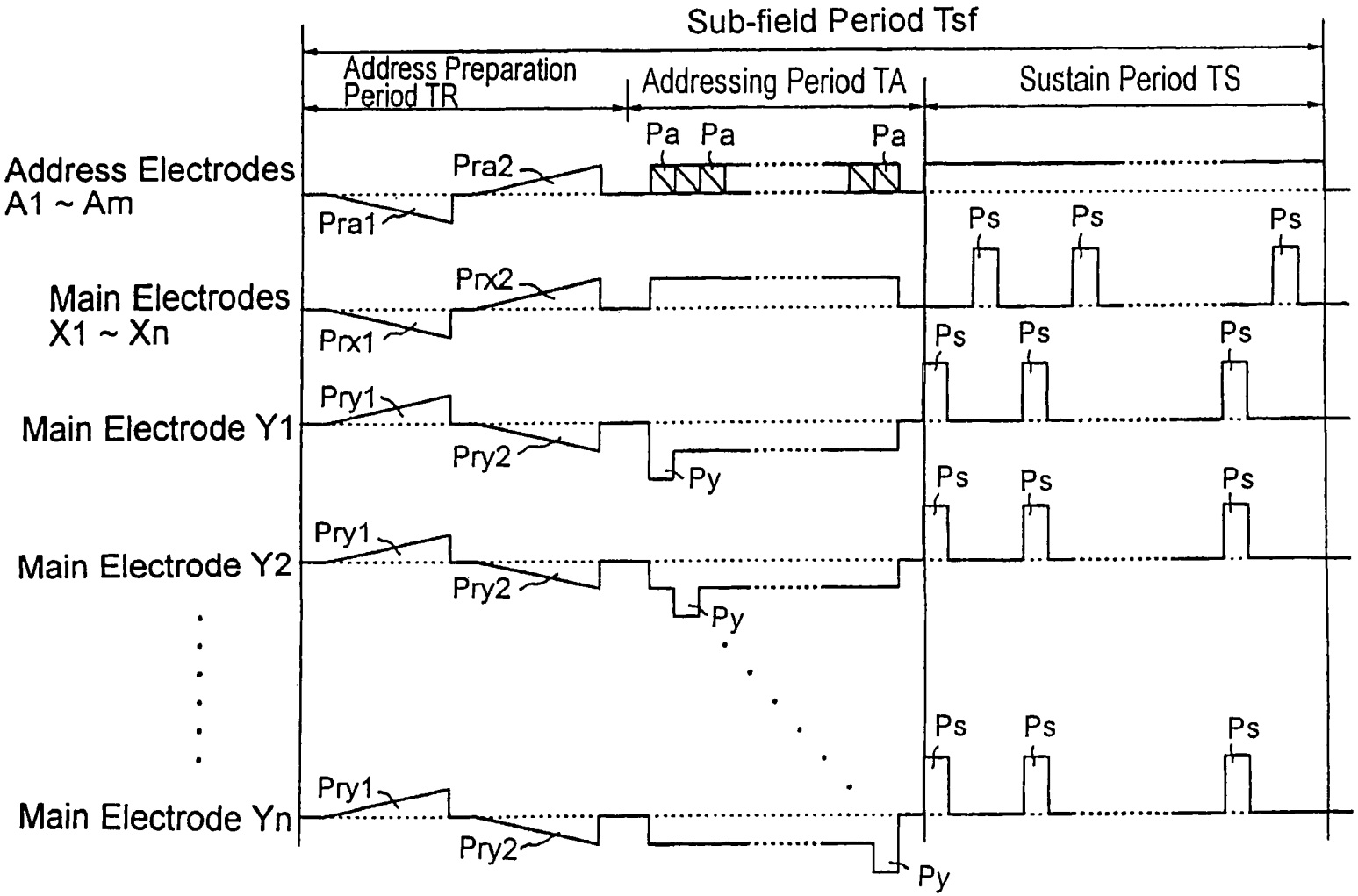
FIG. 7 shows voltage waveforms illustrating a drive sequence according to a first embodiment.

FIG. 7 shows voltage waveforms illustrating a drive sequence according to a first embodiment. In this figure, the signs X and Y representing the main electrodes are accompanied by numerals (1, 2, . . . , n) indicating the order of lines corresponding to the main electrodes, and the signs A representing the address electrodes are accompanied by numerals (1 to m) indicating the order of columns corresponding to the address electrodes. Like numerals are seen in other figures described later.

The outline of a drive sequence repeated in every sub-field is as follows:

In the address preparation period TR, a pulse Pra1 and a pulse Pra2 of different polarities are sequentially applied to all the address electrodes A1 to Am, a pulse Prx1 and a pulse Prx2 of different polarities are sequentially applied to all the first main electrodes X1 to Xn, and a pulse Pry1 and a pulse Pry2 of different polarities are sequentially applied to all the second main electrodes Y1 to Yn. Here the application of a pulse to bias an electrode to a potential different from a reference potential (e.g., grounding potential). In this embodiment, the pulses Pra1, Pra2, Prx1, Prx2, Pry1 and Pry2 are ramp voltage pulses having change rates which allow the feeble discharge to occur, the pulses Pra1 and Prx1 are negative, and the pulse Pry1 is positive.

The application of the pulses Pra2, Prx2 and Pry2 is equal to the application of the charge adjusting voltage explained with reference to FIG. 1. The pulses Pra1, Prx1, and Pry1 are applied to produce proper wall charges in "previously illuminated cells" which have been illuminated in the sub-field immediately before the current sub-field and in "previously non-illuminated cells" which have not been illuminated in the sub-field immediately before the current sub-field. The application of the pulses Pra1, Prx1 and Pry1 is equal to the application of the aforesaid charge producing voltage.

In the address period TA, the lines are selected one by one and a scan pulse Py is applied to the second main electrode Y on the selected line. At the same time as the lines are selected, an address pulse Pa of polarity opposite to the scan pulse Py is applied to the address electrode A corresponding to a cell where the address discharge is to be generated. In the case of a write addressing, the address pulse Pa is applied to a cell to be illuminated in the current sub-field (a cell to be illuminated) and, on the other hand, in the case of an erase addressing, the address pulse Pa is applied to a cell not to be illuminated in the current sub-field (a cell not to be illuminated). An exemplary embodiment is applicable to the addressings of both types. However, the drive sequence shown in FIG. 7 is of the write addressing.

In a cell to which the scan pulse Py and the address pulse Pa are applied, a discharge is generated between the address electrode A and the main electrode Y. This discharge triggers a discharge between the main electrodes X and Y. An address discharge, which is a set of these discharges, is related to the firing voltage $Vf_{AY}$ between the address electrode A and the main electrode Y (hereafter referred to as "electrode gap AY") and the firing voltage $Vf_{XY}$ between the main electrodes X and Y (hereafter referred to "electrode gap XY"). Therefore, in the address preparation period TR, the adjustment of the wall voltage is executed at the electrode gap XY and at the electrode gap AY.

During the sustain period TS, a sustain pulse PS of a predetermined polarity (of positive polarity in the embodiment) is applied to all the main electrodes Y1 to Yn first. Then the sustain pulse Ps is applied alternately to the main electrodes X1 to Xn and to the main electrode Y1 to Yn. In this embodiment, the last sustain pulse Ps is applied to the main electrodes X1 to Xn. By the application of sustain pulse Ps, a surface discharge is generated in the cell to be illuminated in the current sub-field in which cell the wall charge have been retained in the address period TA. Every time the surface discharge occurs, the polarity of the wall voltage between the electrodes is reversed. It is noted that, in order to prevent an unnecessary discharge, all the address electrodes A1 to Am are biased to the same polarity as that of the sustain pulse Ps.

Figure 8:
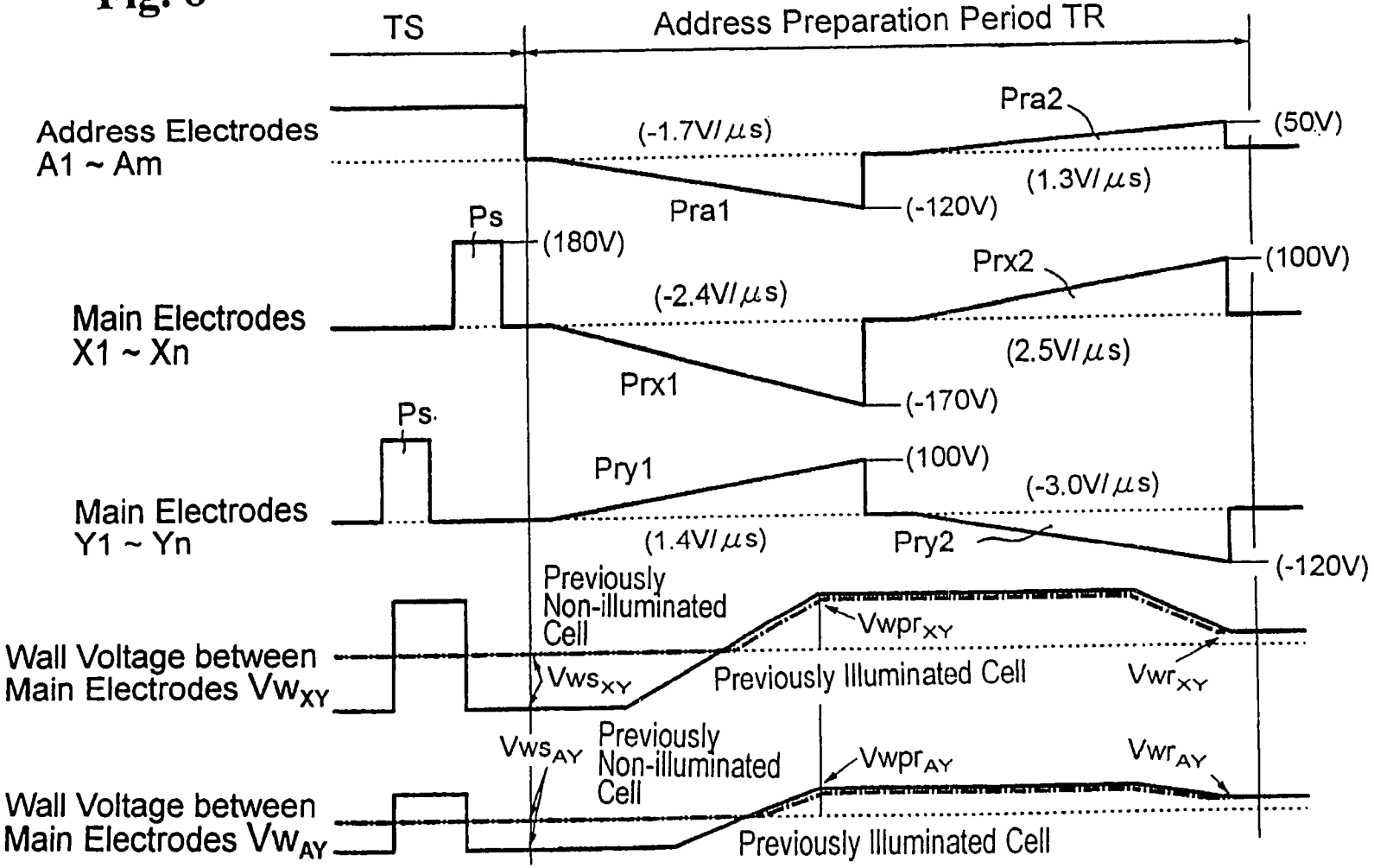
FIG. 8 shows waveforms of applied voltages and wall voltages in correspondence with the drive sequence shown in FIG. 7.

FIG. 8 shows waveforms of the applied voltages and wall voltages in the drive sequence shown in FIG. 7. In this figure, the change rates and the maximum values of the ramp voltages are illustrated.

Effect of the application of the pulses in the address preparation period TR varies depending upon whether or not a cell has been illuminated in the last sub-field.

Cell not Illuminated in the Last Sub-Field

First, in a cell not illuminated in the last sub-field, the wall voltages $Vws_{XY}$ at the electrode gap XY and $Vws_{AY}$ at the electrode gap AY are substantially zero at the beginning of the address preparation period TR as indicated by alternate long and short dash lines in the figure. When the pulses Prx1, Pra1 and Pra1 are applied, the feeble discharge starts to take place at the time when the applied voltages exceed the firing voltages $Vf_{XY}$ and $Vf_{AY}$ at the electrode gaps XY and AY, respectively. To generate a discharge in the cell not illuminated in the last sub-field, the maximum value $Vpr_{XY}$ of the voltage applied to the electrode gap XY and the maximum value $Vpr_{AY}$ of the voltage applied to the electrode gap AY must satisfy the following formulae (3) and (4):

$$Vpr_{XY} > Vf_{XY} \quad \text{Formula (3)}$$

$$Vpr_{AY} > Vf_{AY} \quad \text{Formula (4)}$$

Numerals parenthesized in the figure indicate exemplary values in the case of $Vf_{XY}=220\pm\alpha$ volts and $Vf_{AY}=170\pm\beta$ volts. In this embodiment, $Vpr_{XY}$ is 270 (=170+100) volts and $Vpr_{AY}$ is 220 (=120+100) volts.

If the wall voltages at the electrode gaps XY and AY at the end of the application of the pulses Pra1, Pra1 and Pra1 are assumed to be $Vwp_{XY}$ and $Vwp_{AY}$, respectively, the following formulae (5) and (6) hold:

$$Vwpr_{XY} = Vpr_{XY} - Vf_{XY} \quad \text{Formula (5)}$$

$$Vwpr_{AY} = Vpr_{AY} - Vf_{AY} \quad \text{Formula (6)}$$

A condition for generating a discharge when the pulses Prx2, Pry2 and Pra2 are applied subsequently to the application of the pulses Prx1, Pry1 and Pra1 is represented by the formulae (7) and (8), letting the maximum values of the voltages applied at the electrode gaps XY and AY be VrXY and VrAY, respectively:

$$Vrx_{XY} + Vwpr_{XY} > Vf_{XY} \quad \text{Formula (7)}$$

$$Vr_{AY} + Vwpr_{AY} > Vf_{AY} \quad \text{Formula (8)}$$

Letting the wall voltages at the electrode gaps XY and AY at the end of the application of the pulses Prx2, Pry2 and Pra2 be $Vwr_{XY}$ and $Vwr_{AY}$, respectively, the following formulae (9) and (10) hold:

$$Vwr_{XY} = Vf_{XY} - Vr_{XY} \quad \text{Formula (9)}$$

$$Vwr_{AY} = Vf_{AY} - Vr_{AY} \quad \text{Formula (10)}$$

If $Vr_{XY}$ and $Vr_{AY}$ exceed the firing voltages, the polarity of the wall charge changes. In the case of the write addressing, the wall voltage $Vwr_{XY}$ must be small enough not to generate a discharge during the sustain period TS. Also because a discharge must not occur at the electrode gap AY in cells other than the cells to which the address pulse Pa and the scan pulse Py are simultaneously applied in addressing, the $Vwr_{AY}$ must be small enough.

The wall voltages $Vwr_{XY}$ and $Vwr_{AY}$ may also be set near zero. Since there are differences in the firing voltages among the cells, the wall voltages take values near the differences, which are small. As obviously seen from the formulae (7) to (10), the wall voltages have a relation represented by the following formulae (11) and (12):

$$Vwpr_{XY} > Vwr_{XY} \quad \text{Formula (11)}$$

$$Vwpr_{AY} > Vwr_{AY} \quad \text{Formula (12)}$$

Accordingly, if $Vwr_{XY}$ and $Vwr_{AY}$ are small, $Vwp_{XY}$ and $Vwpr_{AY}$ can be set small. When $Vwr_{XY}$, $Vwr_{XY}$, $Vwpr_{XY}$ and $Vwpr_{AY}$ are small, the wall voltage changes only slightly at the discharge for charge production and at the discharge for charge adjustment, and the amount of emitted light is also small.

Cell Illuminated in the Last Sub-Field

In a cell illuminated in the last sub-field, on the other hand, the polarity of the wall voltage is reversed by the pulses Prx1, Pry1 and Pra1. At the beginning of the address preparation period TR, since the wall charge near the address electrode A is substantially zero, the wall voltage $Vws_{AY}$ at the electrode gap AY is half of the wall voltage $Vws_{XY}$ at the electrode gap XY.

Since the polarities of the wall voltages $Vws_{XY}$ and $Vws_{AY}$ are the same as the polarities of the voltages applied by the pulses Prx1, Pry1 and Pra1, a discharge occurs if the formulae (3) and (4) are satisfied. If the discharge occurs, the wall voltages after the application of the pulses Prx1, Pry1 and Pra1 become the same as those in the cell not illuminated in the last sub-field. Accordingly, the application of the pulses Prx2, Pry2 and Pra2 causes the same change in the wall voltages as in the cell not illuminated in the last sub-field.

Figure 9:
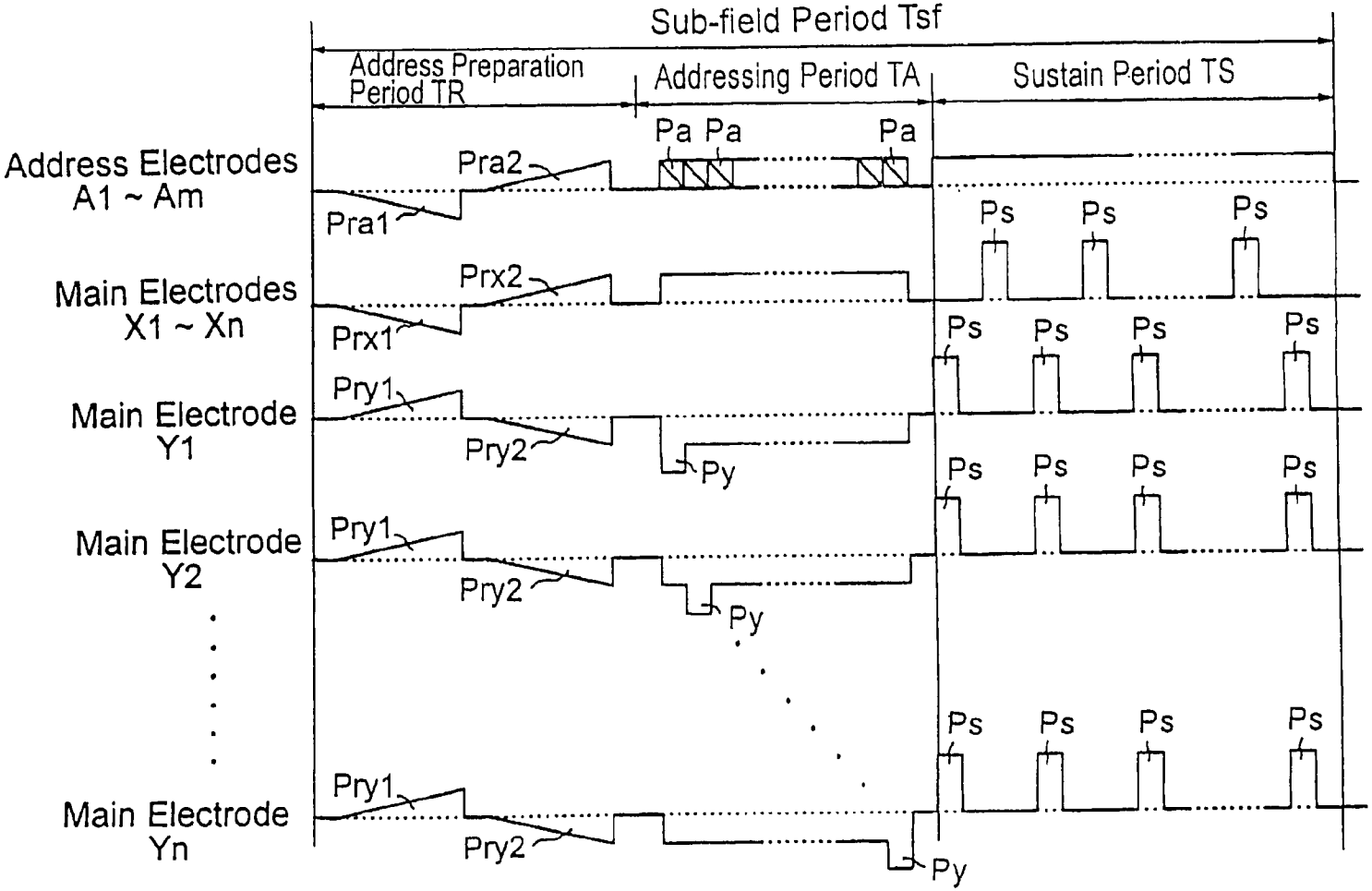
FIG. 9 shows voltage waveforms illustrating a drive sequence according to a second embodiment.

FIG. 9 shows voltage waveforms illustrating a drive sequence according to a second embodiment. From comparison of this embodiment with the embodiment of FIG. 7, it is understood that there is no restriction on the number of the sustain pulses Ps. In the above-discussed embodiment of FIG. 7, the last sustain pulse Ps is applied to the main electrodes X1 to Xn. In this embodiment, on the other hand, the last sustain pulse Ps is applied to the main electrodes Y1 to Yn. Accordingly, the polarities of the wall voltages at the end of the sustain period TS are reverse to those in the embodiment of FIG. 7. However, pulses Prx1, Pry1, Pra1, Prx2, Pry2 and Pra2 of the same conditions as those in the embodiment of FIG. 7 are applied in the address preparation period TR.

Figure 10:
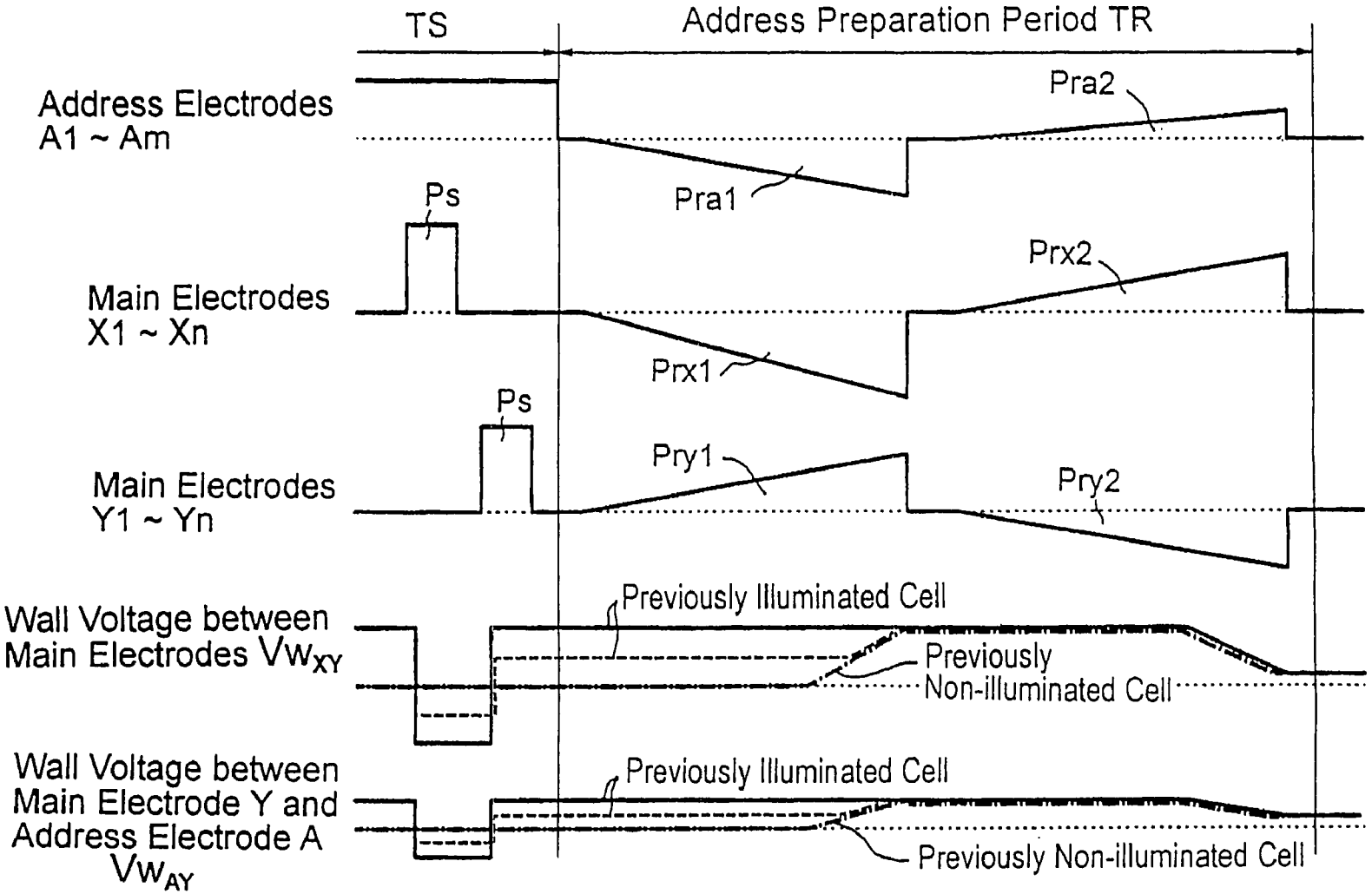
FIG. 10 shows waveforms of applied voltages and wall voltages in correspondence with the drive sequence shown in FIG. 9.

FIG. 10 shows waveforms of the applied voltages and wall voltages in the drive sequence shown in FIG. 9.

The change of wall voltages in a cell not illuminated in the last sub-field is the same as in FIG. 7. In a cell illuminated in the last sub-field, the selection of the maximum values of the pulses Prx1, Pra1 and Pra1 affects the occurrence of a discharge. In the figure, the change of the wall voltages generating the discharge is indicated by broken lines and the change of the wall voltages not generating the discharge is indicated by solid lines.

The conditions for generating discharges at the electrode gaps XY and AY are represented by the following formulae (13) and (14):

$$Vpr_{XY}-Vws_{XY}>Vf_{XY} \quad \text{Formula (13)}$$

$$Vpr_{AY}-Vws_{AY}>Vf_{AY} \quad \text{Formula (14)}$$

The wall voltages $Vwpr_{XY}$ and $Vwpr_{AY}$ at the end of the application of the pulses Prx1, Pry1 and Pra1 defers depending upon whether or not discharges are generated by the application of the pulses Prx1, Pry1 and Pra1, and are represented by the following formulae (15), (15'), (16) and (16'):

$$Vwpr_{XY}=Vpr_{XY}-Vf_{XY} \text{ (Discharge occurs)} \quad \text{Formula (15)}$$

$$Vwpr_{XY}=Vws_{XY} \text{ (Discharge does not occur)} \quad \text{Formula (15')}$$

$$Vwpr_{AY}=Vpr_{AY}-Vf_{AY} \text{ (Discharge occurs)} \quad \text{Formula (16)}$$

$$Vwpr_{XY}=VWS_{AY} \text{ (Discharge does not occur)} \quad \text{Formula (16')}$$

However, regardless of whether or not the discharges take place by the application of the pulses Prx1, Pry1 and Pra1, the following formulae (17) and (18) hold:

$$Vwpr_{XY}\geqq Vpr_{XY}-Vf_{XY} \quad \text{Formula (17)}$$

$$Vwpr_{AY}\geqq Vpr_{AY}-Vf_{AY} \quad \text{Formula (18)}$$

Taking the formulae (5) to (8) into consideration it is understood that a discharge is surely generated by the application of the pulses Prx2, Pry2 and Pra2.

Figure 11:
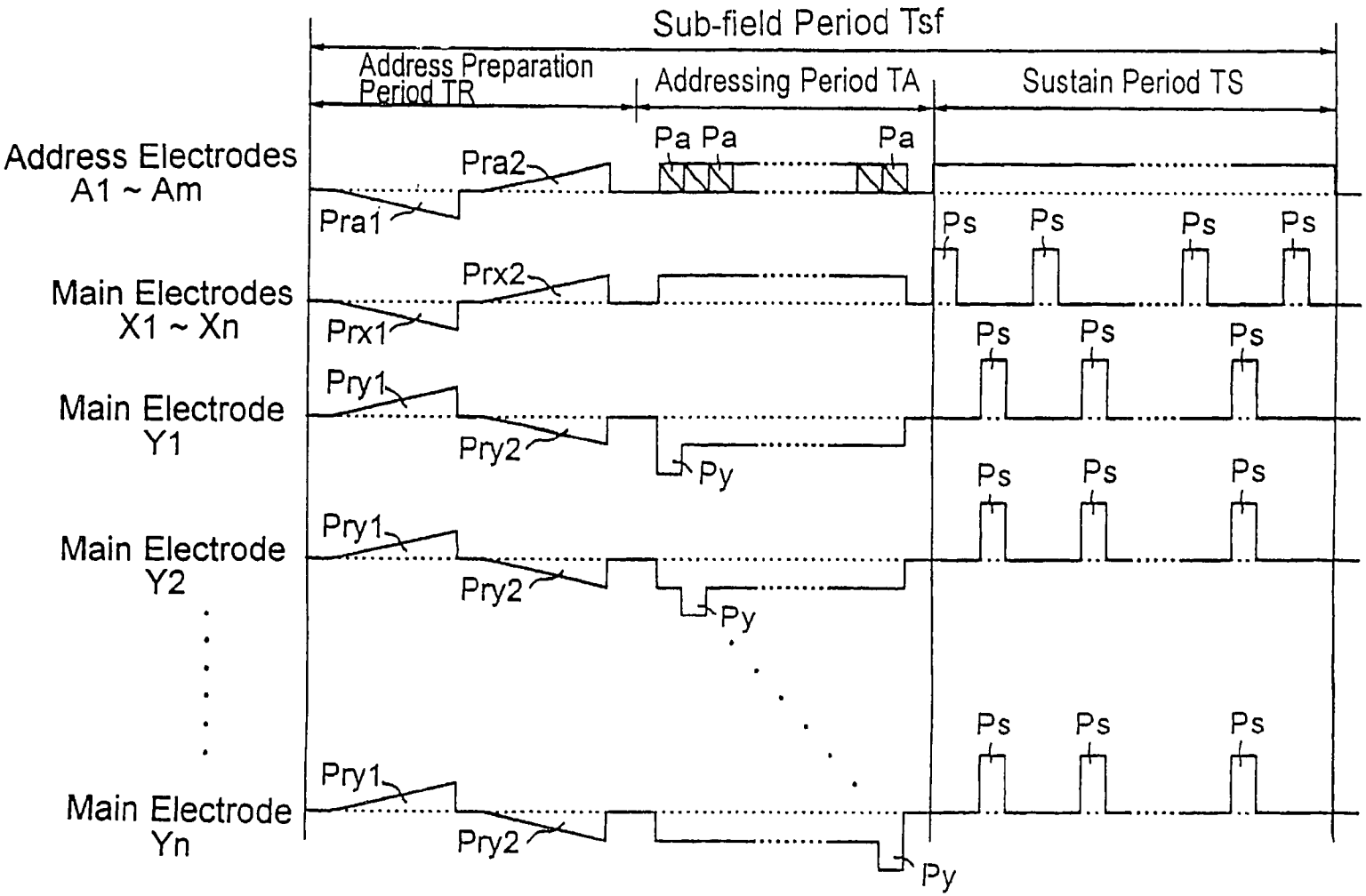
FIG. 11 shows voltage waveforms illustrating a drive sequence according to a third embodiment.

FIG. 11 shows voltage waveforms illustrating a drive sequence according to a third embodiment. Though the above-discussed first and second embodiments are examples of driving methods of write addressing type in which the address discharge is generated in cells to be illuminated in the current sub-field, an exemplary embodiment is also applicable to a driving method of erase addressing type in which the address discharge is generated in cells not to be illuminated in the current sub-field.

Between the drive sequence of FIG. 7 and that of FIG. 11, there lies a difference as to which electrode the first sustain pulse Ps is applied to. In the erase addressing, since a negative wall charge remains on the main electrode Y1 to Yn and a positive wall charge remains on the main electrode X1 to Xn at the end of the address period TA, the sustain pulse Ps is applied to the main electrodes X1 to X2. In the case where the sustain pulse Ps is of negative polarity, the sustain pulse Ps is first applied to the main electrodes Y1 to Y2. In the illustration, the last sustain pulse Ps is applied to the main electrodes X1 to Xn, but it may be applied to the main electrode Y1 to Yn. Even in the erase addressing, the number of sustain pulses Ps can be set on a one-by-one basis for every sub-field.

The change of the wall voltages during the address period TR is the same as in the embodiments 1 and 2. However, the wall voltage $Vwr_{XY}$ at the electrode gap XY at the end of the address preparation period TR must be large enough for sustaining illumination. The wall charge is positive on the side of the main electrode Y. According to the wall voltage $Vwr_{XY}$, the wall voltage $Vwpr_{AY}$ is set large.

Figure 12:
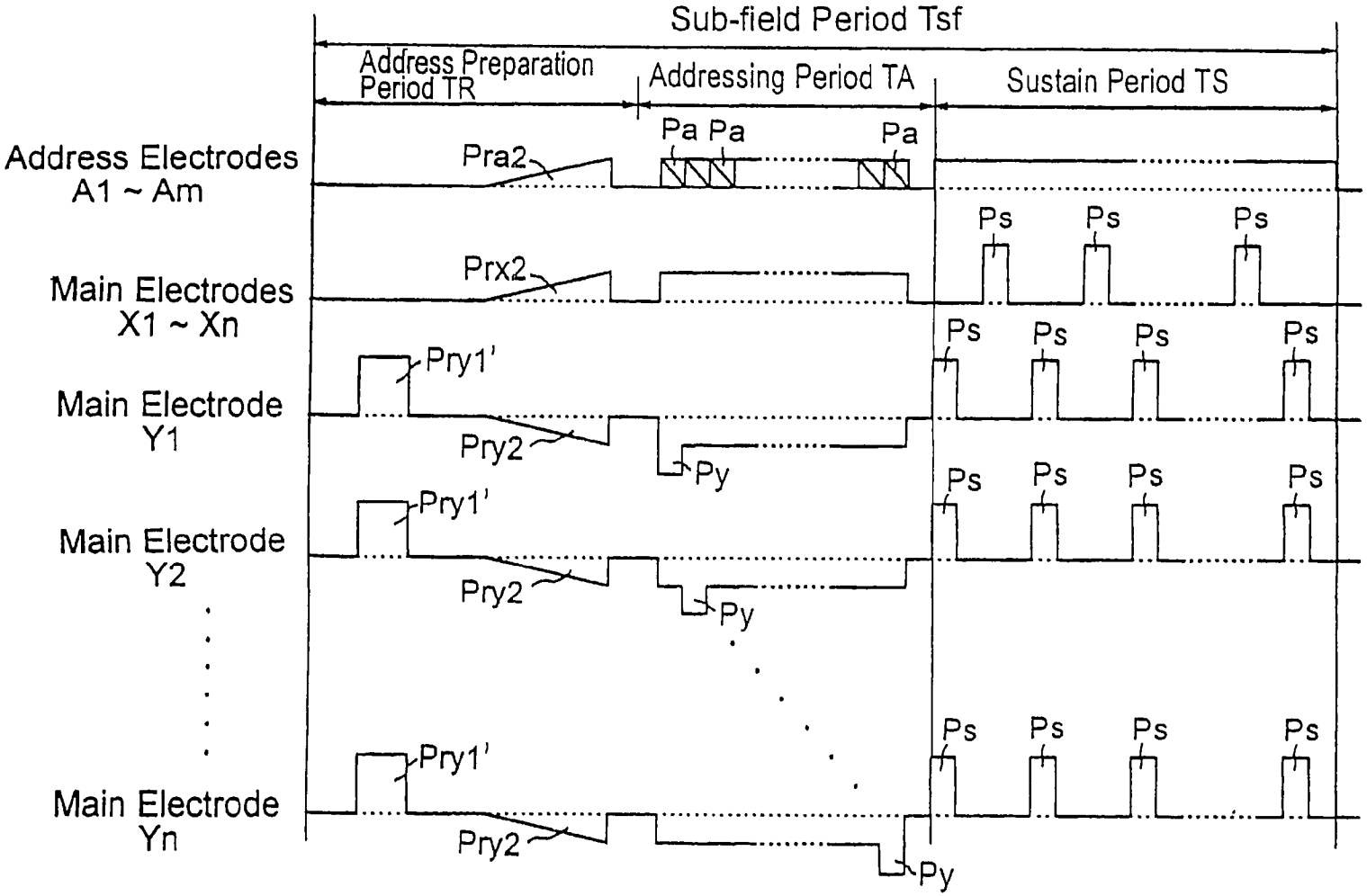
FIG. 12 shows voltage waveforms illustrating a drive sequence according to a fourth embodiment.

FIG. 12 shows voltage waveforms illustrating a drive sequence according to a fourth embodiment.

In the address preparation period TR, a pulse Pry1' in a rectangular waveform is applied to all the main electrodes Y1 to Yn to produce a predetermined wall voltage in all the cells, prior to the charge adjustment by the application of the pulses Prx2, Pry2 and Pra2. The wave height of the pulse Pry1' is set to exceed the firing voltages $Vf_{XY}$ and $Vf_{AY}$.

Figure 13:
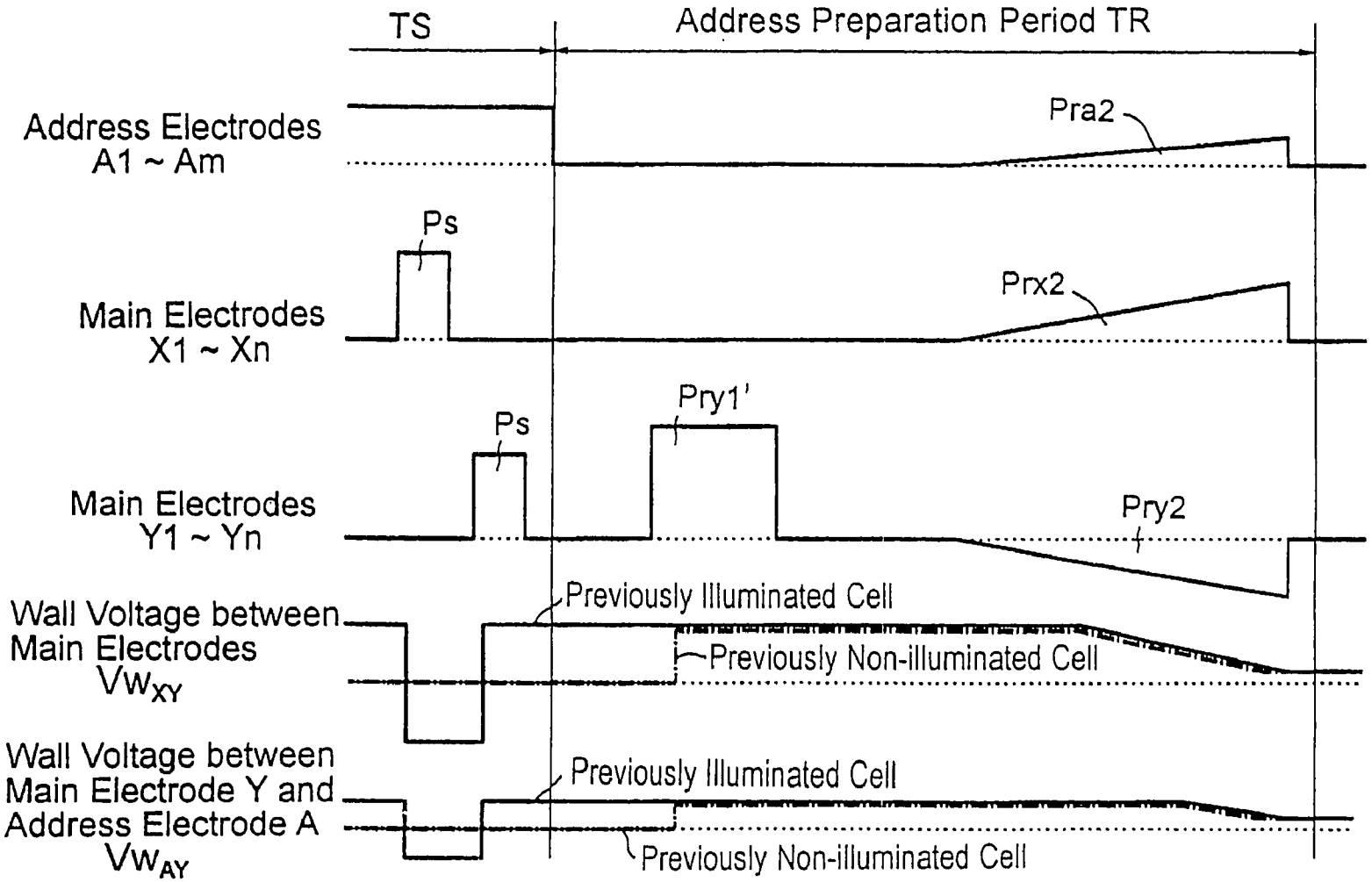
FIG. 13 shows waveforms of applied voltages and wall voltages in correspondence with the drive sequence shown in FIG. 12.

FIG. 13 shows waveforms of the applied voltages and wall voltages in the drive sequence shown in FIG. 12.

In a cell not illuminated in the last sub-field, one discharge is generated by the application of the pulse Pry1'. This discharge produces the wall voltages $Vwpr_{XY}$ and $Vwpr_{AY}$. The change of the wall voltages after the application of the pulses Prx2, Pry2 and Pra2 is the same as in the first embodiment. However, in the case of the erase addressing, the wave height of the pulse Pry1' must be set such that the wall voltage $Vwr_{XY}$ becomes sufficiently large at the end of the application of the pulses Prx2, Pry2 and Pra2.

In a cell illuminated in the last sub-field, the application of the pulse Pry1' does not cause a discharge because the polarity of the pulse Pry1' is reverse to that of the wall voltage $Vws_{XY}$ at the application thereof. Thus this is the same as the case where the pulses Prx1, Pry1 and Pra1 do not generate a discharge in the embodiment 2, and the following formulae (19) and (20) hold:

$$Vwpr_{XY}=Vws_{XY} \quad \text{Formula (19)}$$

$$Vwpr_{AY}=VWS_{AY} \quad \text{Formula (20)}$$

Figure 14:
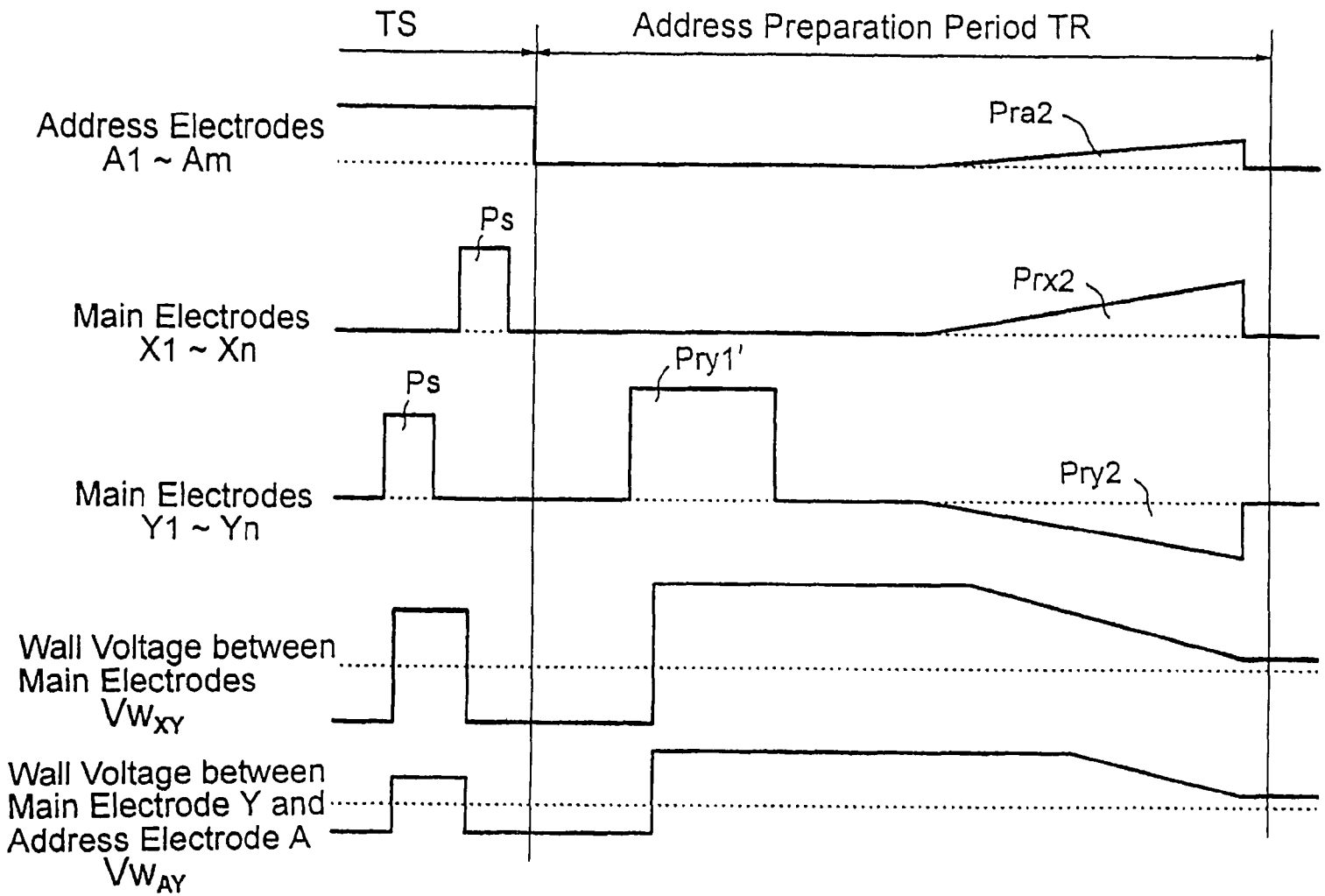
FIG. 14 shows waveforms of applied voltages and wall, voltages illustrating a modification of the drive sequence shown in FIG. 12.

FIG. 14 shows waveforms of applied voltages and wall voltages illustrating a modification of the drive sequence shown in FIG. 12.

Since $Vws_{XY}$ is large enough for sustaining illumination, the erase addressing may be adopted without problems. That is, even if the polarity of the wall voltages at the end of the sustain period TS is reverse to that in the embodiment of FIG. 13, as shown in FIG. 14, a proper address preparation can be performed. However, the application of the pulse Pry1' generates a discharge also in the cell illuminated in the last sub-field. The change of the wall voltages in the cell not, illuminated in the last sub-field is independent of the polarity of the wall voltages at the end of the sustain period TS.

Figure 15:
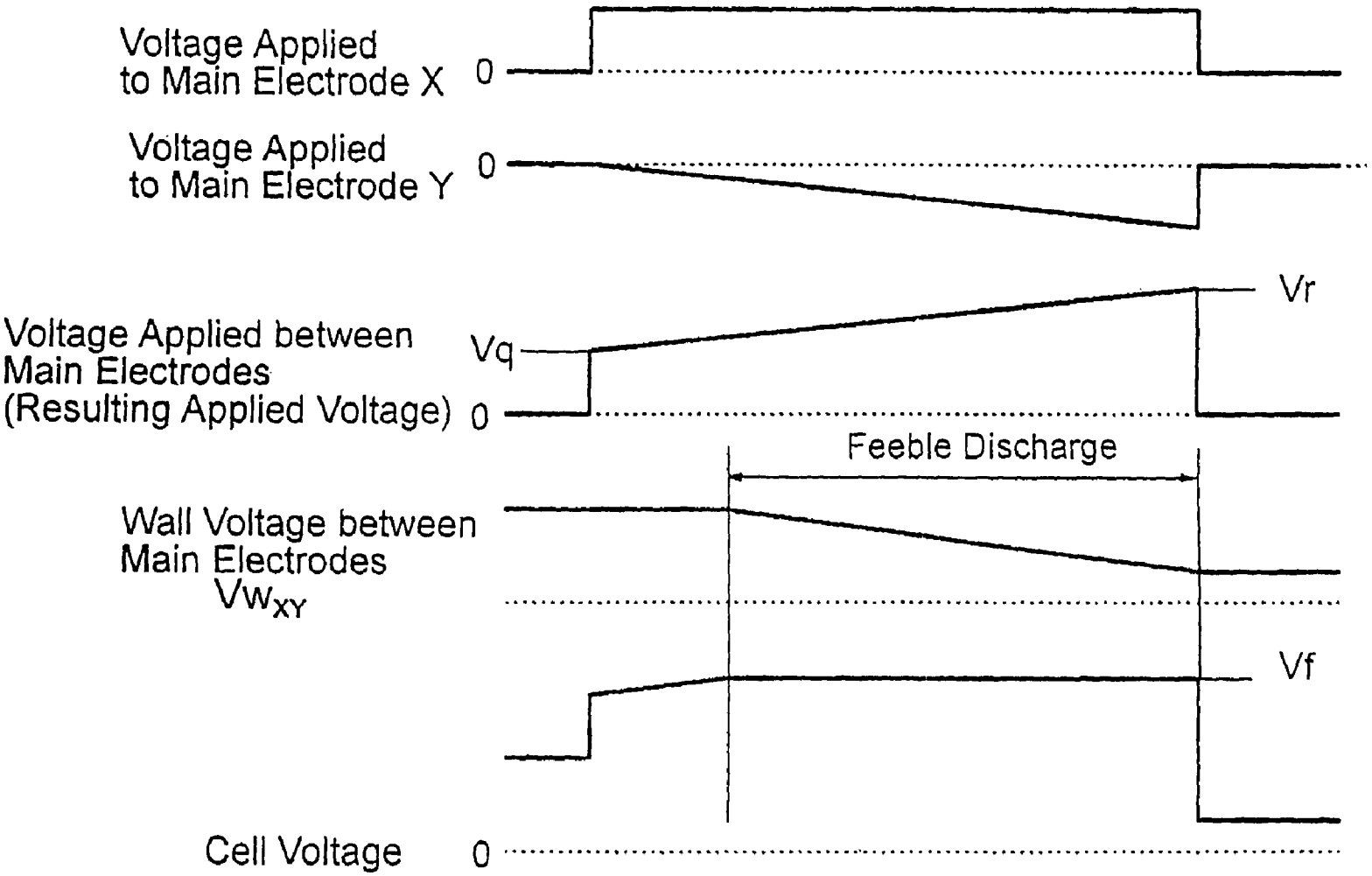
FIG. 15 illustrates a first modification of driving waveforms.

FIG. 15 illustrates a first modification of driving waveforms.

The voltage applied for generating the feeble discharge does not necessarily need to be raised from zero with a constant change rate. Since a discharge does not occur until the applied voltage reaches the firing voltage Vf, the voltage may be set to rise briskly to a set value Vq within such a range that the cell voltage does not exceed the firing voltage and then rise gradually to a set value Vr, in consideration of the wall voltages. As illustrated, for example, if a voltage in a rectangular waveform is applied to the main electrode X and a voltage in a ramp waveform is applied to the other main electrode Y, a resultant applied voltage at the electrode gaps XY is in a trapezoid waveform.

Figure 16:
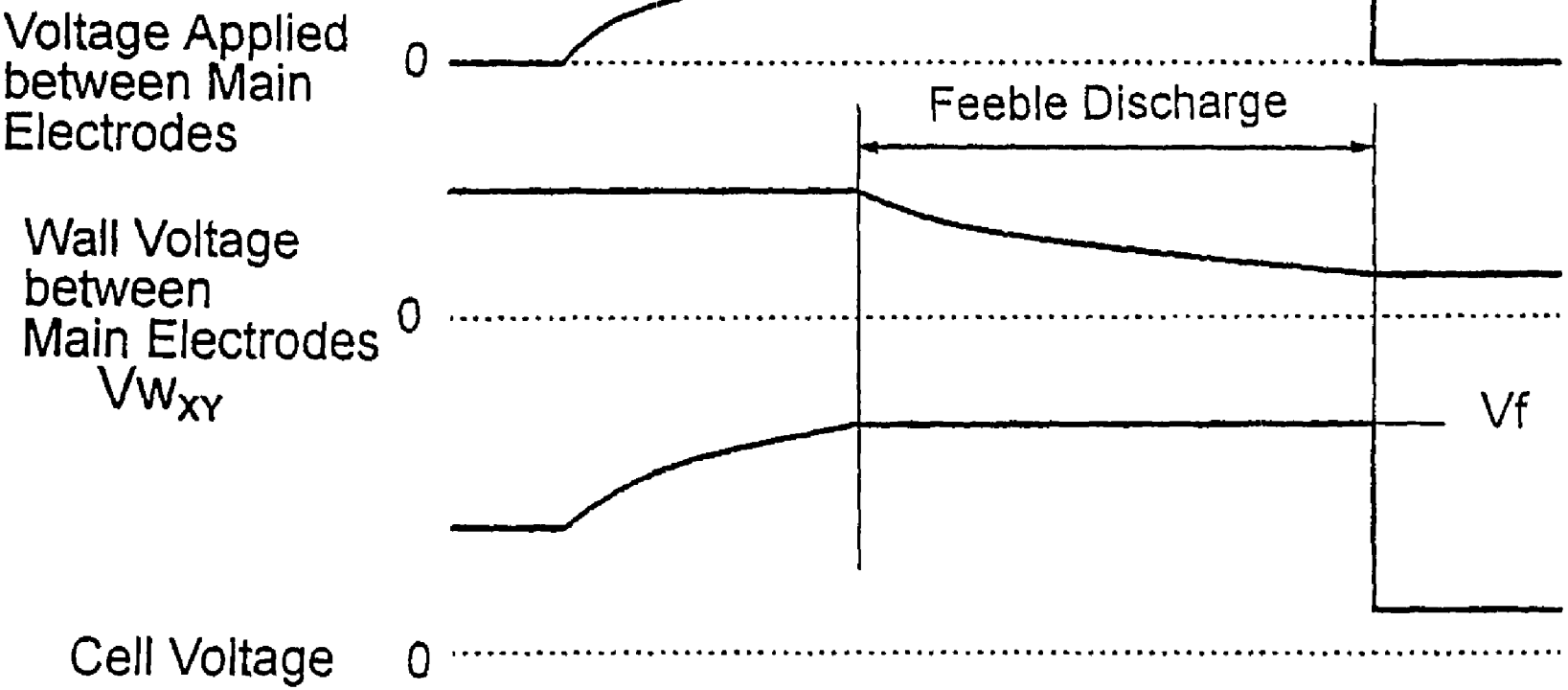
FIG. 16 illustrates a second modification of driving waveforms.

FIG. 16 illustrates a second modification of driving waveforms.

The feeble discharge can be generated by applying a voltage in a gentle waveform instead of the ramp voltage. However, the cell voltage must not reach the firing voltage before the rise of the gentle voltage starts to rise gently.

Figure 17:
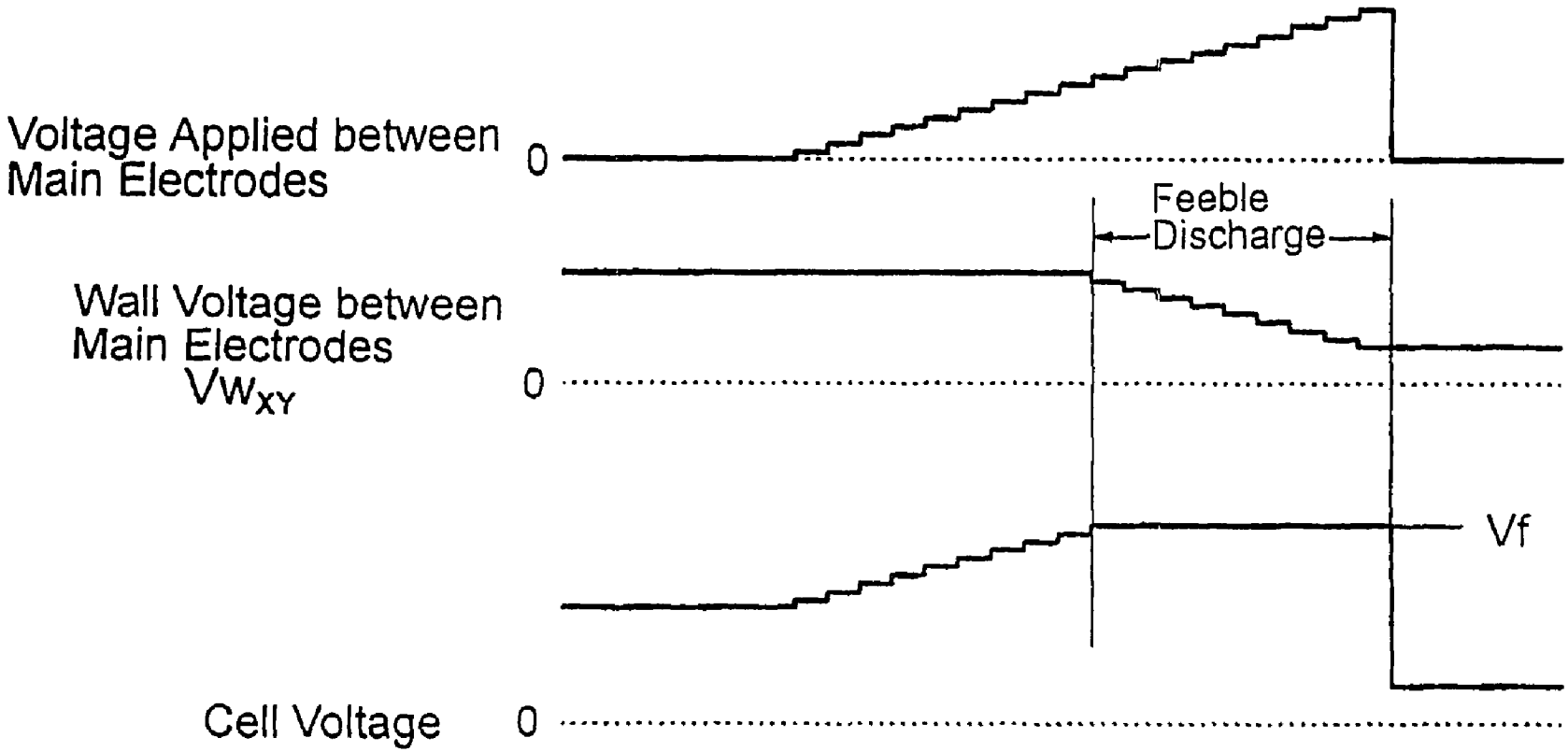
FIG. 17 illustrates a third modification of driving waveforms.

FIG. 17 illustrates a third modification of driving waveforms.

The feeble discharge can be generated by applying a voltage in a stepwise waveform having small steps instead of the ramp voltage. The intensity of the feeble discharge can be controlled by the setting of the steps.

The above described embodiments are applied for driving a PDP1 constructed to have the main electrodes X and Y and the address electrode A covered with the dielectric. However, an exemplary embodiment can also be applied for a construction such that only one electrode of the main electrode pair is covered with the dielectric. For example, in a construction such that the address electrode is not covered with the dielectric and in a construction such that one of the main electrodes X and Y is exposed in the discharge space 30, proper wall charges can be produced at the electrode gaps XY and AY. The polarity, value, application time and rise rate of applied voltages are not limited to those in the embodiments. Furthermore, an exemplary embodiment can be applied not only for display devices such PDPs and PALC devices but also for other gas electric discharge devices having such structures that wall charges affects the generation of discharges. Further, the discharges are not necessarily generated for display.

According to an exemplary embodiment, the reduction of the voltage margin due to variations in firing voltage can be eliminated, and the reliability of driving can be improved.

Further, the luminance of the background can be decreased when images are displayed, whereby the contrast of display can be improved.

Further, restriction on the polarity of applied voltages can be eased and flexibility of drive sequences can be improved.

Further, according to an aspect of the embodiments, any combinations of the described features, functions and/or operations can be provided.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

What is claimed is:

1. A method for driving an AC type surface-discharge display device having a plurality of cells arranged in a matrix, each of the cells having a pair of a first main electrode and a second main electrode disposed on every line of the matrix and an address electrode disposed on every column of the matrix, the method comprising:

providing an address preparation period in which a charge producing pulse and a charge adjusting pulse are applied, and also providing an addressing period in which each line of the matrix is scanned;

applying the charge producing pulse, which has a positive polarity, to the second main electrode used as a scan electrode to generate discharges accompanied by accumulation of wall charges both between the first main electrode and the second main electrode and between the second main electrode and the address electrode, due to a potential difference between the second main electrode and the first main electrode and a potential difference between the second main electrode and the address electrode;

applying the charge adjusting pulse, which has a waveform monotonously changing from a first set value potential to a second set value potential in a negative direction and has a negative polarity, to the second main electrode used as a scan electrode, to generate discharges accompanied by a decrease of wall charges produced by application of the charge producing pulse both between the first main electrode and the second main electrode and between the second main electrode and the address electrode, due to a potential difference between the second main electrode and the first main electrode and a potential difference between the second main electrode and the address electrode; and applying a negative scan pulse, which has a potential lower than the second set value potential at the completion of the charge adjusting pulse, to the second main electrode in the addressing period.

2. The method for driving a surface-discharge display device according to claim 1, wherein the charge adjusting pulse is a ramp or gentle waveform voltage pulse.

3. The method for driving a surface-discharge display device according to claim 1, wherein when the charge adjusting pulse is applied, a positive auxiliary pulse insufficient to generate a discharge independently is applied to the first main electrode so that a potential difference between the first main electrode and the second main electrode attains a potential of the auxiliary pulse and then monotonously increases to the second set value potential.

4. The method for driving a surface-discharge display device according to claim 1, wherein the charge adjusting pulse has a stepwise waveform.

5. A method for driving an AC type surface-discharge display device having a plurality of cells arranged in a matrix, each of the cells having a pair of a first main electrode and a second main electrode disposed on every line of the matrix and an address electrode disposed on every column of the matrix, the method comprising:

providing an address preparation period and an addressing period;

in the address preparation period, applying a first charge adjusting voltage, which monotonously rises from a first set value to a second set value with the first main electrode as a positive electrode and the second main electrode as a negative electrode, between the first main electrode and the second main electrode;

applying a second charge adjusting voltage, which monotonously rises from a third set value to a fourth set value with the address electrode as a positive electrode and the second main electrode as a negative electrode, between the second main electrode used as a scan electrode and the address electrode; and thereby generating discharges between the first main electrode and the second main electrode and between the second main electrode and the address electrode within a period of voltage change until voltages applied between the first main electrode and the second main electrode and between the second main electrode and the address electrode attain the second set value and the fourth set value respectively, to adjust wall charges so as to decrease wall voltages between the first main electrode and the second main electrode and between the second main electrode and the address electrode respectively; and in the addressing period, applying a scan pulse, which has a lower potential than a negative potential on the second main electrode side when the second charge adjusting voltage applied between the second main electrode and the address electrode attains the fourth set value, to a selected second main electrode, and applying an address pulse, which has a polarity opposite to the scan pulse, to a selected address electrode to select a cell.

* * * * *